US007468024B2

(12) United States Patent
Webber et al.

(10) Patent No.: US 7,468,024 B2
(45) **Date of Patent: *Dec. 23, 2008**

(54) TRICEPS DIP EXERCISE MACHINE

(75) Inventors: Randall T. Webber, La Jolla, CA (US); Christopher E. Brennan, Santee, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/961,531

(22) Filed: Dec. 20, 2007

(65) Prior Publication Data

US 2008/0113850 A1 May 15, 2008

Related U.S. Application Data

(63) Continuation of application No. 10/698,908, filed on Oct. 31, 2003, now Pat. No. 7,335,140.

(51) Int. Cl.
*A63B 21/062* (2006.01)
*A63B 21/08* (2006.01)

(52) U.S. Cl. ..... 482/98; 482/97; 482/100

(58) Field of Classification Search ..... 482/93–103, 482/133–138, 72

See application file for complete search history.

(56) References Cited

U.S. PATENT DOCUMENTS

| | | | | | |
|---|---|---|---|---|---|
| 248,121 | A | * | 10/1881 | Tuttle | 482/96 |
| 2,145,940 | A | | 2/1939 | Marlowe | |
| 4,641,833 | A | | 2/1987 | Trethewey | |
| 4,684,126 | A | | 8/1987 | Dalebout et al. | |
| 4,822,038 | A | | 4/1989 | Maag | |
| 5,100,128 | A | * | 3/1992 | Mabry et al. | 482/134 |
| 5,254,067 | A | | 10/1993 | Habing et al. | |
| 5,334,120 | A | * | 8/1994 | Rasmussen | 482/97 |
| D357,041 | S | | 4/1995 | McBride et al. | |
| 5,417,634 | A | | 5/1995 | Habing | |
| 5,478,298 | A | | 12/1995 | Chen | |
| 5,520,599 | A | | 5/1996 | Chen | |
| 5,527,243 | A | | 6/1996 | Chen | |
| 5,533,953 | A | | 7/1996 | Lui et al. | |
| D372,509 | S | | 8/1996 | Yang | |
| 5,547,444 | A | | 8/1996 | Huang | |
| 5,643,147 | A | | 7/1997 | Huang | |
| D384,118 | S | | 9/1997 | Deblauw | |
| 5,669,865 | A | * | 9/1997 | Gordon | 482/142 |
| 5,720,695 | A | | 2/1998 | Eckmann | |
| 5,722,918 | A | | 3/1998 | Lee | |
| 5,733,232 | A | * | 3/1998 | Hsu | 482/133 |

(Continued)

*Primary Examiner*—Fenn C Mathew
(74) *Attorney, Agent, or Firm*—Procopio, Cory, Hargreaves & Savitch LLP

(57) ABSTRACT

A triceps dip exercise machine has a main frame, a user support frame movably mounted on the frame, an exercise arm movably mounted on one of the frames, a connecting link connecting movement of the exercise arm to movement of the user support frame, such that movement of the exercise arm between a start and end position simultaneously moves the user support frame from a start to an end position, and an exercise resistance for resisting movement of one of the moving parts. The arrangement is such that the combined movement of the exercise arm and user support frame substantially replicates the natural movement of the upper part of the human body when performing a free bar, suspended triceps dip exercise.

27 Claims, 22 Drawing Sheets

U.S. PATENT DOCUMENTS

| | | | | |
|---|---|---|---|---|
| 5,749,813 | A * | 5/1998 | Domzalski | 482/97 |
| 5,803,882 | A * | 9/1998 | Habing et al. | 482/136 |
| 5,938,570 | A | 8/1999 | Maresh | |
| 6,491,609 | B2 * | 12/2002 | Webber | 482/99 |
| 6,605,024 | B2 * | 8/2003 | Stearns | 482/142 |
| 6,971,978 | B2 | 12/2005 | Hyder | |
| 7,070,545 | B2 | 7/2006 | Lull et al. | |
| 7,335,140 | B2 * | 2/2008 | Webber et al. | 482/98 |
| 7,357,761 | B2 | 4/2008 | Mattox | |
| 2002/0187879 | A1 | 12/2002 | Ball et al. | |
| 2003/0199362 | A1 | 10/2003 | Chamberlin | |
| 2005/0032611 | A1 * | 2/2005 | Webber et al. | 482/72 |
| 2007/0293377 | A1 | 12/2007 | Webber et al. | |
| 2007/0293378 | A1 | 12/2007 | Webber et al. | |
| 2008/0058176 | A1 | 3/2008 | Webber et al. | |
| 2008/0058177 | A1 | 3/2008 | Webber et al. | |
| 2008/0058181 | A1 | 3/2008 | Webber et al. | |

* cited by examiner 106
25
105
24
112
108
110
104
100
14
102
16
34
33
22
23
21
26
12
15

TRICEPS DIP EXERCISE MACHINE

RELATED APPLICATION

The present application is a Continuation of U.S. patent application Ser. No. 10/698,908 filed on Oct. 31, 2003, now U.S. Pat. No. 7,335,140, the entire disclosure of which is incorporated herein by reference.

BACKGROUND

1. Field of the Invention

This invention relates generally to exercise machines, and is particularly concerned with an exercise machine for performing triceps dip exercises which has a moving user support.

2. Related Art

Free bar triceps dip exercises are typically performed by a user gripping two parallel bars, and lifting themselves from a position in which their elbows are bent with their hands just above their waist, and their body in a forward lean, into a position in which their arms extend straight down the side centerline of their body. The starting forward lean is a natural balancing by-product of a suspended exerciser performing a free bar triceps dip or bar dip exercise. The dip movement is one of the most fundamental exercises, and is performed by professional gymnasts, fitness training enthusiasts, as well as children in school yards. It is one of the standard measures of strength and fitness endurance. However, it can be difficult to many people to perform, requiring balance and coordination as well as strength for someone to raise and lower their body while trying to balance themselves with their hands. This exercise involves a compound or multi-joint movement that involves the shoulder, triceps, and chest muscles. Improper form by the exerciser, for example swinging, leaning too far forward, or arching backward, can make the exercise more difficult, increasing stress to the joints and potentially leading to injury.

The counter-balanced dip machine was developed to help less conditioned exercisers perform dip exercises and to provide a safer exercise. Some prior art triceps dip exercise machines have a fixed user support and a pivoting exercise arm linked to a suitable resistance. This results in an exaggerated and unnatural arcing movement which does not accurately duplicate a free bar dip exercise. Some examples of prior art exercise machines for performing both chin-up and dip exercises which have moving user supports are U.S. Pat. No. 3,707,285 of Martin, U.S. Pat. No. 5,011,139 of Towley, U.S. Pat. No. 5,322,489 of Webb, U.S. Pat. No. 5,449,959 of Holmes, and U.S. Pat. No. 5,540,639 of Potts. All of these machines use a load to counterbalance the user's body weight and assist them in performing the exercise, and have exercise arms which are stationary and fixed to the main frame. In Holmes and Webb, the user kneels on the user support, while the user is in a standing position on the support in Martin, Potts, and Towley. In order to perform a dip exercise, the user pushes on the exercise arm handles. While the user support moves in these designs, it is not urged to do so by movement of the exercise arm. The machines are quite large and awkward to use, requiring the user to climb up steps to mount the machines and step blindly backwards onto the steps in order to step off the machine. The starting user hand gripping position for the dip exercise in these machines places the wrists at an uncomfortable and unnatural angle which could lead to injury.

U.S. Pat. No. 5,876,095 of Johnston describes an exercise machine for performing a seated dip exercise. A user support seat is raised when handles are pushed downward. Both the se at and the handles travel in a linear and vertical direction on wheels or rollers mounted on a main frame. The seat is connected to the handles via a tether such as a cable or belt. This-machine also places the user's wrist in an awkward starting position, and relies on the user's body weight to provide exercise resistance, with no provision for adding further resistance.

The triceps press machines described in U.S. Pat. No. 5,421,796 of Jones and U.S. Pat. No. 5,803,882 of Habing work the triceps muscles, but do not involve the pectoral/chest muscles the way a dip exercise does. In both cases, the user support is in a fixed position during the exercise and pivotal movement of an exercise arm is resisted by an exercise resistance, such as a weight stack or the like. These machines do not keep the exerciser's arms aligned with the centerline of their body, which is their natural center of gravity. In Habing, the starting position places the exerciser's hands far in front of their body and forces them to go through a large arc, finishing with the arms positioned past the exerciser's body centerline.

Some known multi-purpose exercise machines for performing various different types of exercise have movable seats or user supports. In U.S. Pat. No. 5,330,405 of Habing, the machine has a stationary base frame, a lever arm pivotally mounted on the frame, and a sub frame pivotally connected to the base frame and supported by the lever arm. The sub frame comprises a user support and an exercise arm linked to the lever arm by cables and pulleys. The exercise arm is pivotally connected to a portion of the sub frame at a location above the user. In order to perform a shoulder press, the user must sit on the user support leaning forward at an angle without benefit of back support, pressing the exercise arm forward and rotating it about its pivotal connection to the sub frame in order to pull the cables and cause the sub frame to lift.

U.S. Pat. No. 5,669,865 of Gordon describes a multi-purpose exercise machine with a hinged, two-piece user support that folds and unfolds with each exercise repetition. The user support comprises a seat portion and a back portion which are pivotally connected together, and is pivotally connected to the main frame. A first exercise arm pivoted to the frame provides pressing and pull down exercises. The seat and back rest do not travel in a fixed relationship to each other, but fold and unfold during the exercise, working the abdominal and low back muscles even when other exercises are being performed. Due to the separate motion of the seat and back rest, additional supports such as a foot rest, safety belts, and thigh gripping surfaces are required to keep the user properly and safely-positioned. In this machine, most of the combined weight of the user and user support remains on one side of the gravitational centerline of the user support, and this weight is used as a partial exercise resistance. Due to the working of the abdominal and low back muscles in every exercise movement, including press exercises, the exerciser cannot properly isolate any one specific muscle or muscle group. Because of this, the exerciser cannot fully fatigue other muscles, since the abdominal and lower back muscles will always fatigue first.

SUMMARY

In one embodiment, a triceps dip exercise machine is provided, which comprises a main frame having a user support mount, a forward end, and a rear end, a user support frame movably mounted on the user support mount for supporting a user in an exercise ready position facing the forward end of the frame and movable between a start position and an end position, the start position comprising a forwardly inclined position, an exercise arm movably mounted on one of the frames, the exercise arm having handles for gripping by a user in performing a triceps dip exercise and the exercise arm being movable between a start position and an end position, a connecting linkage connecting movement of the exercise arm to movement of the user support, whereby movement of the exercise arm from the start to the end position simultaneously moves the user support frame from the start to the end position, and a load for resisting movement of at least one of the moving parts of the machine, the combined motion of the user support frame and exercise arm between the start and end position substantially replicating the natural movement of the human body when performing a free bar triceps dip exercise.

In an exemplary embodiment of the invention, the end position of the user support frame is a rearwardly displaced position, and the user support frame has a seat pad and a back pad in a fixed position relative to the seat pad, so that the user's back is supported throughout the exercise. The exercise arm and user support start positions place the handles on opposite sides of the user's body, under the shoulder and adjacent the side centerline of the body, while the end positions of the exercise arm and user support place the handles slightly below the user's hips. This means that the user starts the exercise with their elbows bent and their hands gripping the handles slightly below their shoulders, and finishes the exercise with their arms extending downward on opposite sides of their body. This is the same positioning that an exerciser would have when performing a bar dip exercise on free bars. Because the user is not suspended in this machine, and the exercise arm and user support track each other and self-align during the exercise movement, the handles can be angled to provide a more comfortable starting and finishing position than either a free bar dip exercise or prior art triceps dip exercise machines.

The user support frame in one embodiment is rotatably mounted via a pivot mount on the main frame, and the pivot mount defines a vertical, gravitational center line of the pivotal movement. The pivot mount may be positioned such that the combined weight of the user and user support frame is distributed on each side of the gravitational centerline of the pivot in both the start and end position, so that only a portion of the combined weight passes through the gravitational centerline during the exercise movement, and a major portion of the weight of the user and user support frame does not remain on one side only of the gravitational centerline over the entire exercise movement. The user support frame has a seat support pad and a back support pad in fixed relation to one another which travel together in fixed relative positions between the start and end position of the user support frame, and may also have a foot support or foot plate for supporting the user's feet. The foot rest may alternatively be stationary and mounted on the main frame in front of the user support frame. Either of these arrangements keeps the user safely in the same, supported position throughout the exercise movement.

As the user pushes the exercise arm from the start position to the finish position, the connecting link links the exercise arm movement to the user support frame, which simultaneously and automatically rocks or rotates from the start position to the end position. This rocking movement makes the exercise more fun to perform. The pivoting seat and back rest automatically align with the exercise arm to maintain proper positioning of the user throughout the exercise movement.

The exercise arm may be rotatably mounted on one of the frames, or may be mounted for linear movement on the frame. In one embodiment of the invention, the connecting link pivotally connects the user support frame to the exercise arm so that movement of the exercise arm forces the user support frame to move. In one embodiment of a pivot mounted user support frame, the user support frame may pivot rearward about its pivotal connection to the main frame from a forwardly inclined start position to a rearwardly reclined end position. The connecting link has a first pivot connection to the user support and a second pivot connection to the exercise arm. The first pivot connection may be higher than the second pivot connection, so that the connecting link pulls the user support frame to force it to rotate, or may be lower than the second-pivot connection, so that the connecting link pushes the user support frame. The connecting link may be adjustable and may be rigid or flexible, and may comprise a single link member or a multiple bar linkage.

The triceps dip exercise machine provides proper positioning of the user in the start and end position, as well as a user upper body and arm movement which simulates the natural body movement found in a free bar dip exercise. Because movement of the exercise arm is linked to movement of the user support frame, the self-alignment of the user and user support throughout the exercise motion is automatic and continuous throughout the entire exercise range of motion. This combined movement maintains a suitable alignment relationship between the user positioned on the user support frame and the user engaging means or handles on the exercise arm. The combined motion of the user support frame and exercise arm replicates the small natural arc movement of a traditional free bar triceps dip exercise.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 2:
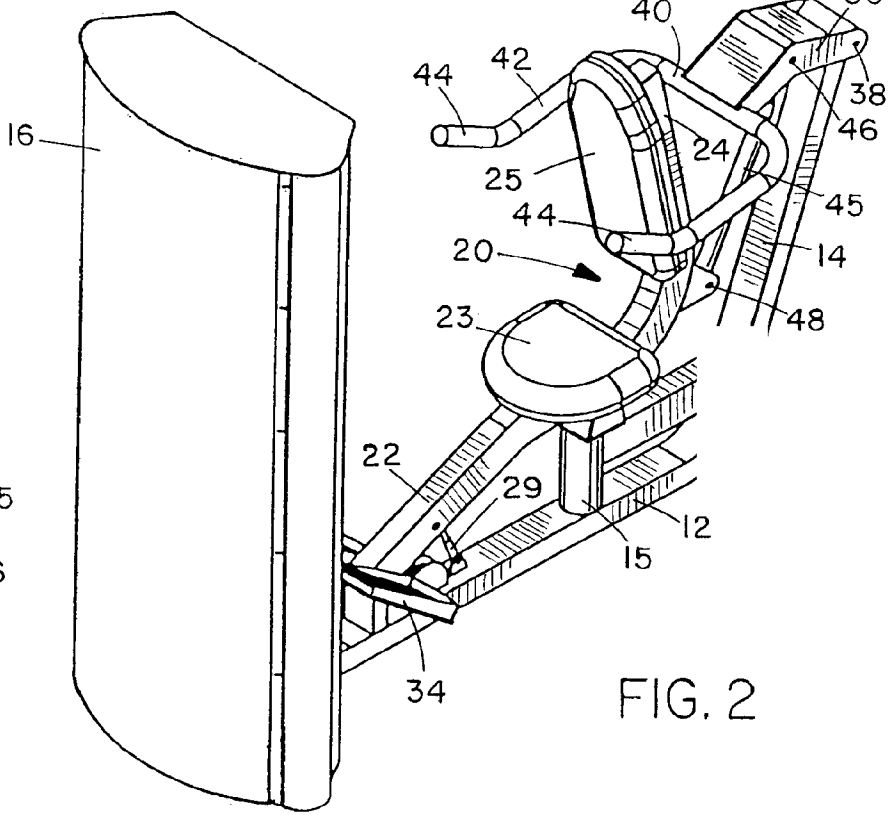
FIG. 2 is a front perspective view of the machine of FIG. 1, also illustrating the exercise start position.

Certain embodiments as disclosed herein provide for a triceps dip exercise machine in which movement of an exercise arm is linked to movement of a user support frame.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 6 illustrate one embodiment of a triceps dip exercise machine 10 for performing an exercise which is equivalent to a free bar dip exercise without the disadvantages of a free bar exercise, i.e. balance, coordination, and strength to follow the proper movement path, and possible injury if the proper movement is not followed. Instead, the triceps dip machine 10 constrains the user to follow the proper exercise path, while fully supporting the user's body in an exercise ready position throughout the exercise for comfort and safety. The exercise carried out by this machine mimics the natural arcing movement and upper body alignment from the start to the finish position of an equivalent free bar triceps dip exercise.

The machine 10 has a main frame comprising a horizontal base 12, a rearwardly and upwardly inclined upright strut 14, a user support mount or pivot mount 15 extending upwardly from the base 12, and an upright weight stack housing 16 at the forward end of base 12. The housing contains a conventional selectorized weight stack 18. A generally L-shaped user support frame 20 is pivotally mounted at the upper end of pivot mount 15 via pivot 21. The user support frame 20 has an elongate base portion 22 on which a seat pad 23 is mounted, and an upright, back support portion 24 on which a back pad 25 is mounted. The pivot 21 is located on the base portion 22 beneath seat pad 23. Base portion 22 is linked to the weight stack or exercise resistance via a cable and pulley linkage 26, part of which is visible in the drawings. The cable and pulley linkage includes a cable, belt or other line 28 which extends from an anchor 29 on the base 12 of the frame, around a pulley 30 on the undersurface of base portion 22 adjacent the forward end of the user support frame, and around a pulley 32 on the base 12, before extending through the base and into the weight stack housing where it is suitably linked to the weight stack 18. A single or double-foot rest or plate 34 is mounted on the forward end of the base portion 22 of the user support frame, such that a user can easily rest their feet on the footplate when seated on the seat pad 23. A support post or rest 33 on the base 12 in front of the user support frame forms a stop or rest for the user support frame in the exercise start position of FIGS. 1, 3 and 5.

An exercise arm 35 is pivotally mounted at the upper end of the upright strut 14 so as to extend forwardly on opposite sides of the user support frame. Arm 35 comprises a pair of parallel plates 36 with rear ends pivotally mounted on opposite sides of upright strut 14 via pivot pin 38, and a U-shaped exercise arm having a central section 40 secured to the forward ends of plates 36 and opposite arms 42 projecting forwardly from the central section on opposite sides of the user support frame, with user engaging devices or handles 44 at the forward ends of the arms, which are bent upwardly relative to the remainder of the arms. The plates 36 are also linked to the user support frame 20 via an elongate connecting link or rod 45 which is pivotally connected at one end to an intermediate point on the plates 36 via pivot 46 and at the opposite end to the lower end of the user support upright 24 via pivot 48. The connecting link translates downward movement of the exercise arm into rearward movement of the user support frame. Because the attachment point of the connecting link to the user support frame is positioned lower than the attachment point to the exercise arm, the connecting link pushes the user support frame to force it to rotate. However, the connecting link may alternatively be designed to pull the user support frame rearwardly, by attaching the connecting link at a different, higher location, for example.

Figure 1:
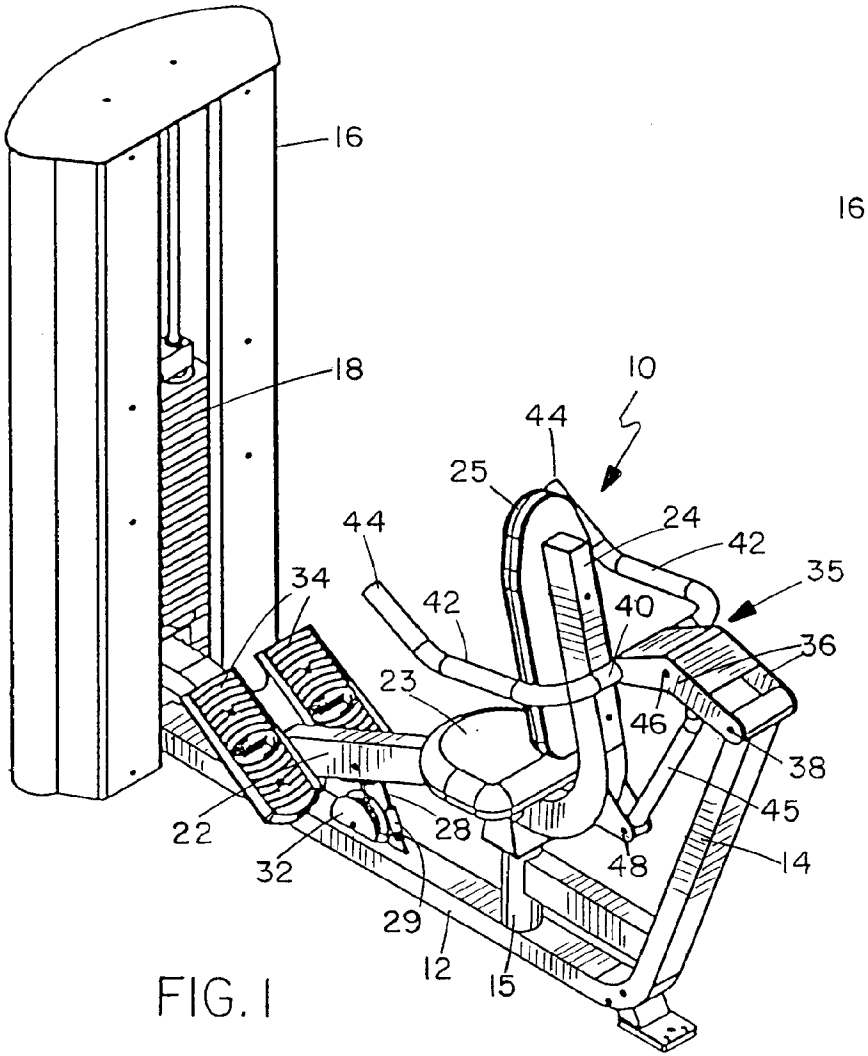
FIG. 1 is a rear perspective view of a triceps dip exercise machine according to a first embodiment, illustrating the exercise start position.
Figure 3:
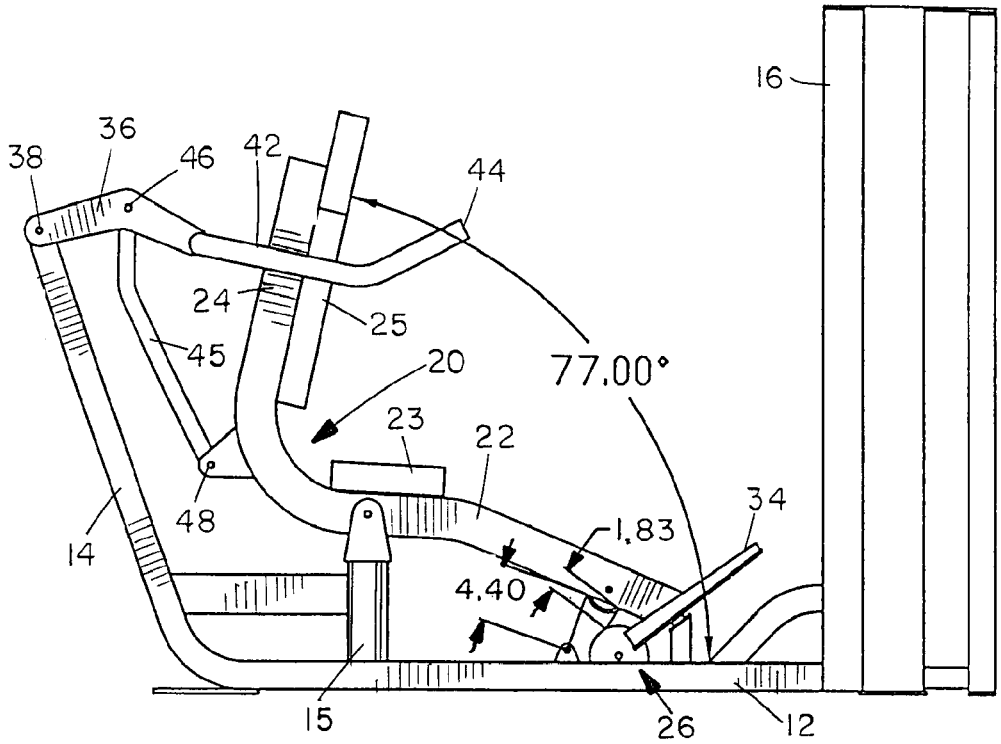
FIG. 3 is a side elevation view of the machine of FIG. 1 in the exercise start position.
Figure 5:
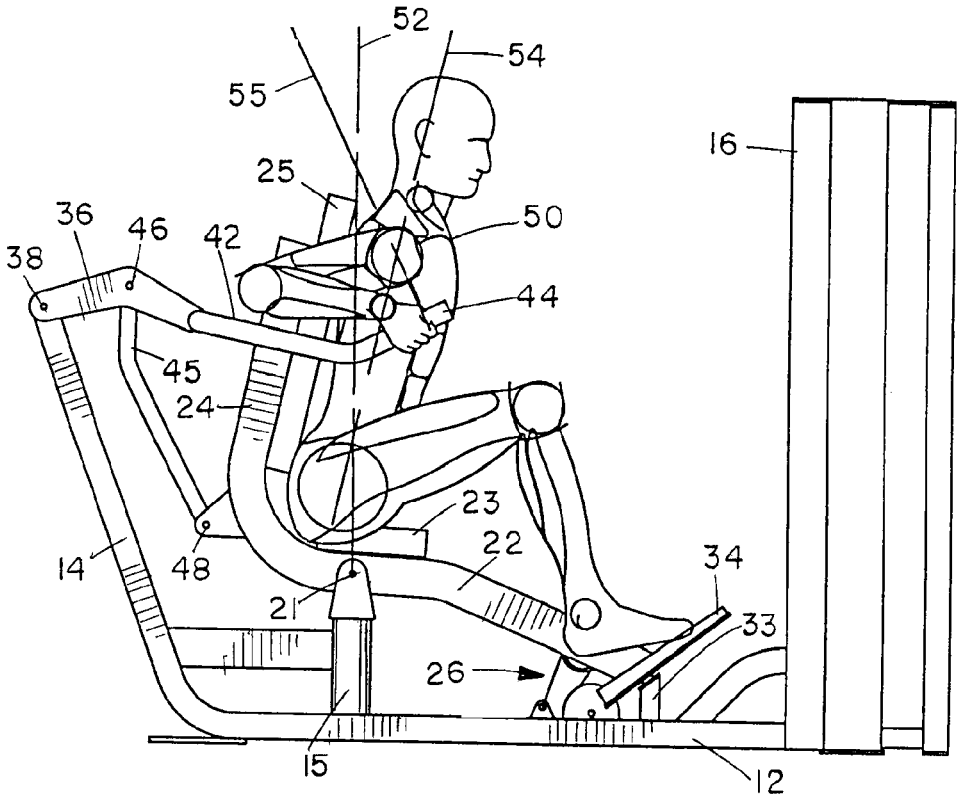
FIG. 5 is a side elevation view similar to FIG. 3, illustrating a user seated on the user support in the exercise start position.
Figure 6:
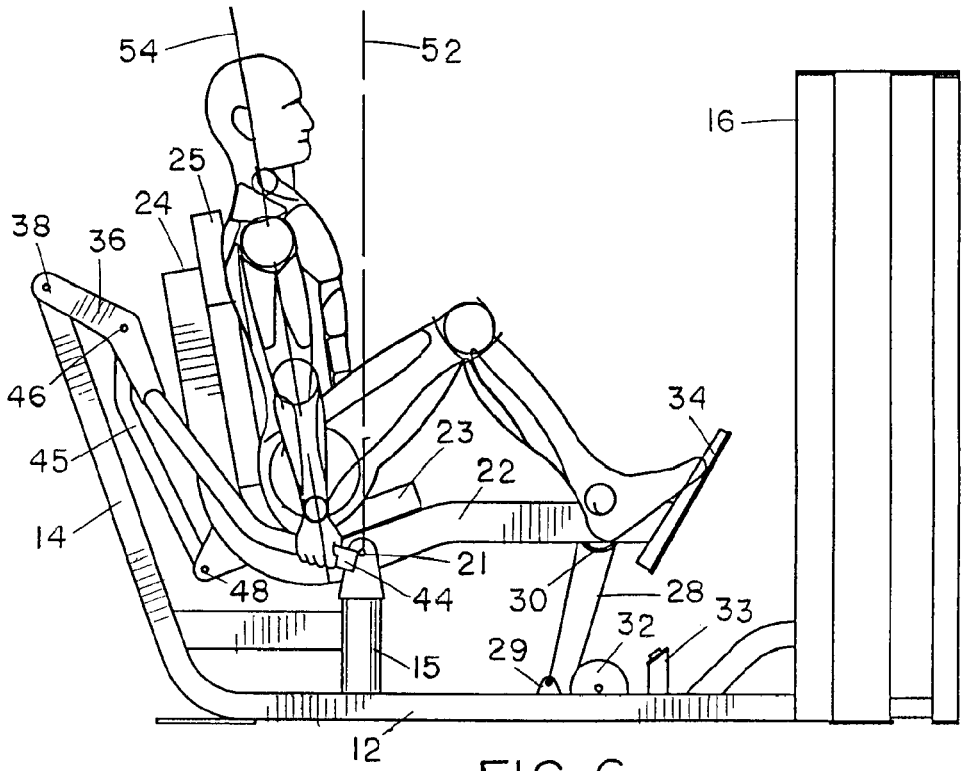
FIG. 6 is a side elevation view similar to FIG. 4, with a user seated on the user support, illustrating the user's position at the end of the triceps dip exercise.

FIGS. 5 and 6 illustrate a user or exerciser 50 performing a bar dip type of exercise on the machine 10, with FIG. 5 illustrating the starting position and FIG. 6 illustrating the finish position. The dotted line 52 is the gravitational center line of the user support pivot, while the dotted line 54 is the side center line of the user's body, and dotted line 55 represents the perpendicular centerline of the user's shoulder relative to the handles 44. In a free bar dip exercise, a user grips two parallel bars on opposite sides of their body. They then pull themselves into a position in which their arms and knees are bent while leaning slightly forwardly for balance. In the starting position using the exercise machine of this embodiment, as illustrated in FIGS. 1, 3 and 5, the user support frame rests in a forward inclined position, with the back support 24 and back pad 25 inclined forward and the seat pad 23 inclined slightly downwardly. The opposite arms 42 of the exercise arm extend generally forward and the handles 44 are located on opposite sides of the user's body, adjacent and below their shoulders.

The user 50 first sits on the seat and places their feet on the footplate 34, and grabs the handles 44 on each side, as illustrated in FIG. 5. This places them into a slightly forward inclined position, with their hands slightly below their shoulders, forward of the side center line of the body and slightly rearward of the shoulder centerline, and their arms and legs bent. This closely mimics the starting position of a free bar dip exercise, but with a less extreme bend to the wrist. The starting position is therefore more comfortable and less stressful than that of a free bar dip exercise. In performing a free bar dip exercise, the exerciser presses downwardly on the bars while raising their body until their arms are straight and aligned with the sides of their body. In the seated dip machine of FIGS. 1 to 6, a similar movement is carried out in order to move into the finish position of FIG. 6. The user 50 pushes the exercise arm downwards until their arms are straight down and aligned with the side centerline 54 of their body. Pushing the handles of the exercise arm down causes the connecting link 45 to push the user support so that it rotates in an anticlockwise or rearward direction about pivot 21, moving the user from the forward inclined position of FIG. 5 into the reclined position of FIG. 6. The user ends with their arms extending downward and in line with the side centerline 54 of their body, mimicking the end position of a free bar dip exercise. The slight rearward movement from the position of FIG. 5 to that of FIG. 6 also mimics the natural rearward arc a person's upper body goes through when performing a free bar dip. With this machine, because the user is not suspended, as in a free bar dip exercise, and the exercise arm and user support have the ability to self-align during the exercise movement, the handles 44 can be angled to provide a more comfortable starting and finishing position with less extreme bending to the wrist than would be encountered in a free bar dip exercise.

Figure 4:
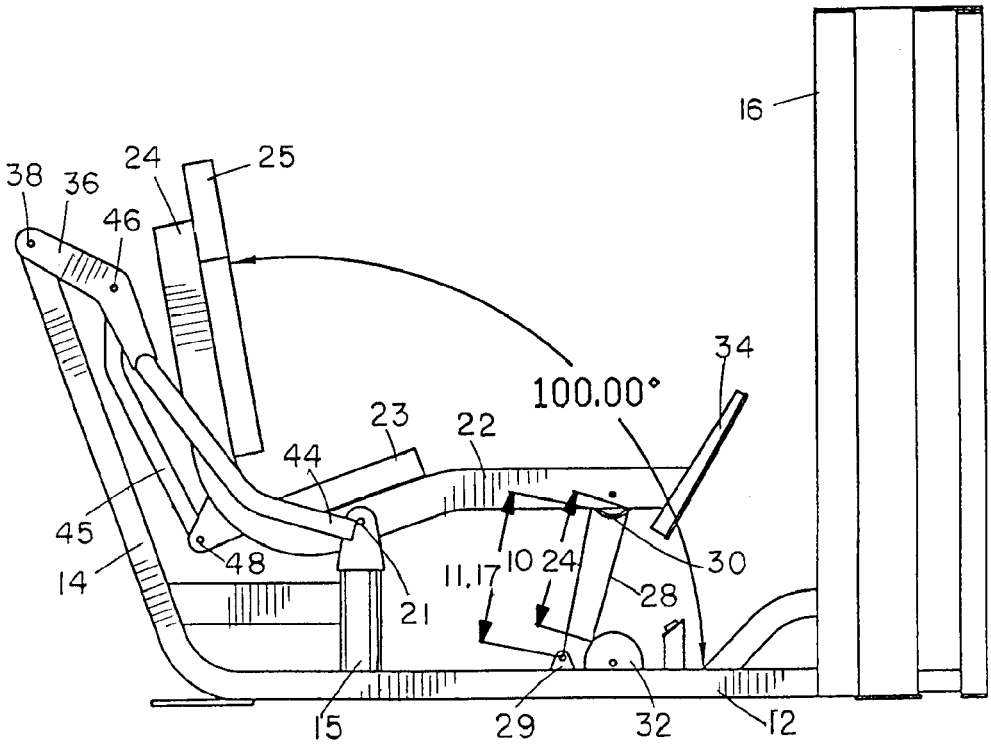
FIG. 4 is a side elevation view similar to FIG. 3, illustrating the exercise end position.

FIGS. 3 and 4 show the angular orientation of the user support 20 in the start and finish position, as well as the amount of cable pull, which determines the resistance felt by the user. The rear upright 24 of the seat starts at an angle of 77 degrees to the horizontal (or 1.3 degrees to the vertical) and is at an angle of 100 degrees to the horizontal (or a rearward reclination of 10 degrees to the vertical). Thus, the user support reclines through an angle of around 23 degrees when moving between the start and finish position. The cable pull is approximately 15 3/16 inches, based on subtracting the added total cable length in the starting position (6.23 inches) from the added total cable length in the end position (21.41 inches).

The user support pivot 21 is positioned directly under the exerciser 50, and a balanced portion of both the user support frame and exerciser is positioned on each side of the gravitational center line 52 of the pivot in both the starting and finish positions of FIGS. 5 and 6. The gravitational center line in the start position runs very close to the centerline of the user's hip. The user starts in a forward lean, approximately 13 degrees off vertical, and finishes in a rearward lean of approximately 10 degrees. This is the same start to finish positioning an exerciser would have when performing a bar dip exercise on free bars, without the disadvantages of free bar exercises. As illustrated in FIGS. 4 and 5, the user support frame in the end position is displaced rearward from the start position, and the base portion 22 of the user support frame is displaced upward from the start position. The combined weight of the user and user support frame is balanced on each side of the gravitational center line of the pivot in both the start and finish position, such that the initial resistive weight of the exercise arm is counterbalanced and there is substantially no resistance drop-off at the end of the exercise. The user starts forward of the gravitational centerline, and finishes with their upper body rearward of the gravitational centerline at the end of the exercise. This balanced distribution of weight minimizes the effect the weight of the user and user support has on the exercise resistance. Thus, there is no need to add a counter-balancing weight to offset the weight of the exercise arm assembly. The combined weight of the user and user support frame has little effect on the amount of starting resistance because a substantially equal amount of weight is balanced rearward of the gravitational centerline in the start position. By the same token, as the user passes rearward past the gravitational centerline, there is no appreciable drop-off in resistance felt by the user because of the amount of combined weight still forward of the centerline.

The rocking movement of the user support frame during the exercise makes the exercise enjoyable to perform, while the user is fully supported for safety and comfort throughout the exercise movement. Repetitious exercise movement can be tedious and boring. By adding rocking movement to the user support frame, in addition to allowing the exercise movement to more accurately mimic that of a free bar exercise, the exercise performance is made more fun and the user's interest in the workout is increased. They are therefore more likely to exercise for an extended period, and to be motivated to exercise regularly.

Figure 7:
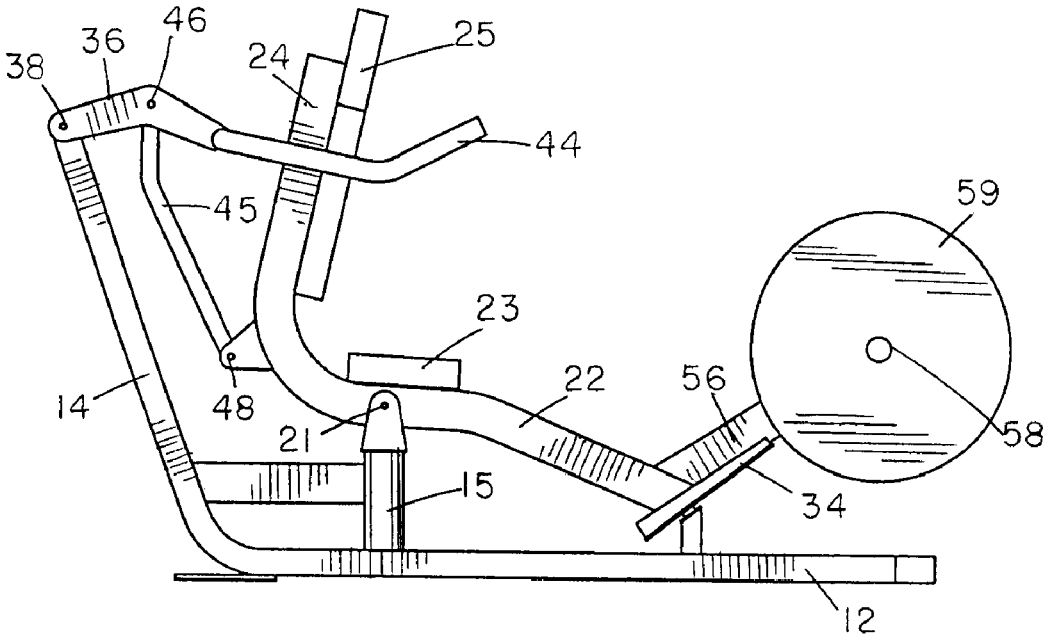
FIG. 7 is a side elevation view of a modified triceps dip exercise machine, illustrating the exercise start position.
Figure 8:
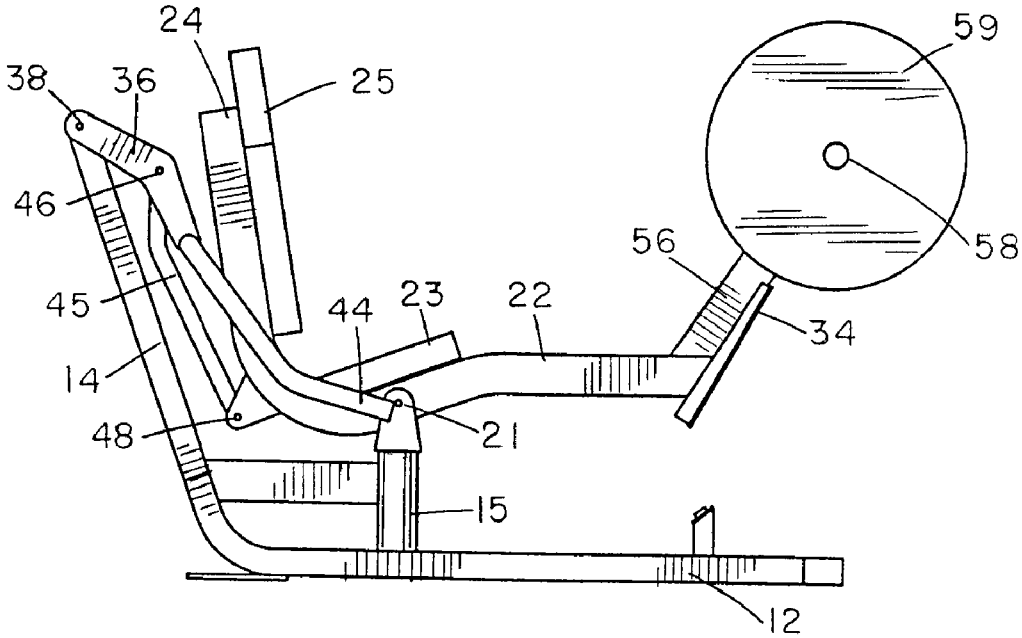
FIG. 8 is a side elevation view of the machine of FIG. 7, illustrating the exercise end position.

FIGS. 7 and 8 illustrate a triceps dip exercise machine similar to that of the previous embodiment but which replaces the resistive weight stack 18 with hand-loaded weight parts. Other parts of the machine of FIGS. 7 and 8 are identical to that of FIGS. 1 to 6, and like reference numerals have been used for like parts as appropriate. A mounting strut 56 extends forward and upwards at an angle from the forward end of the base portion 22 of the user support, and weight pegs 58 project in opposite directions from the forward end of strut 56. A selected number of hand-loaded weight plates 59 can be loaded onto the weight pegs 58 by the user, dependent on the amount of exercise resistance desired. The start position, end position, and exercise movement of the modified machine of FIGS. 7 and 8 are exactly the same as in the previous embodiment. The selectorized weight stack used in any of the embodiments described below may also be replaced by hand-loaded weight plates as in this embodiment.

Figure 9:
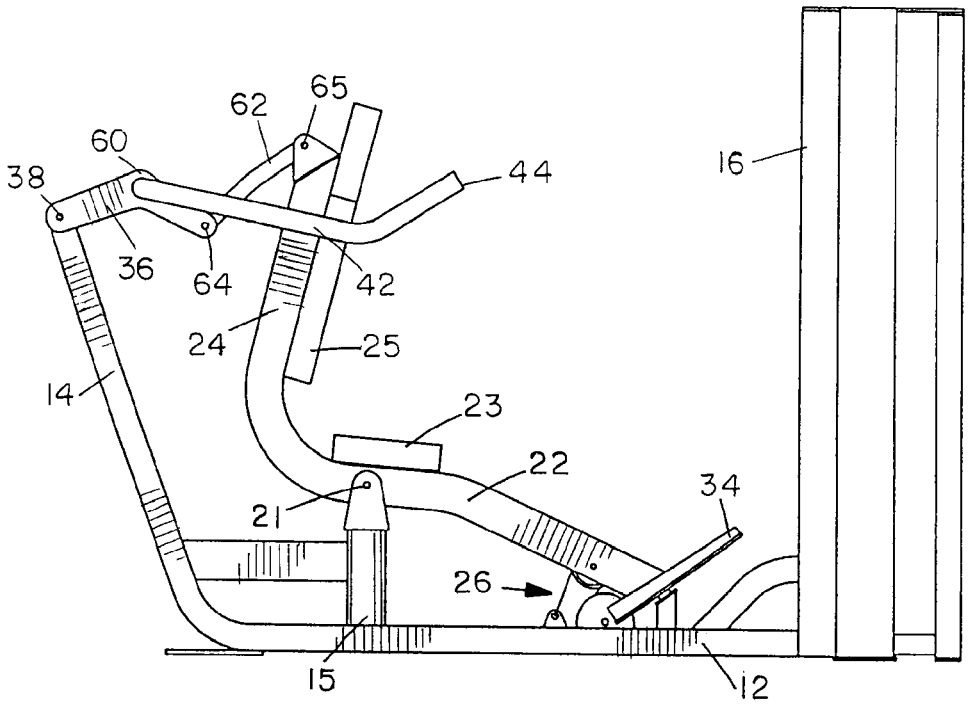
FIG. 9 is a side elevation view of a modified triceps dip exercise machine, illustrating the exercise start position.
Figure 10:
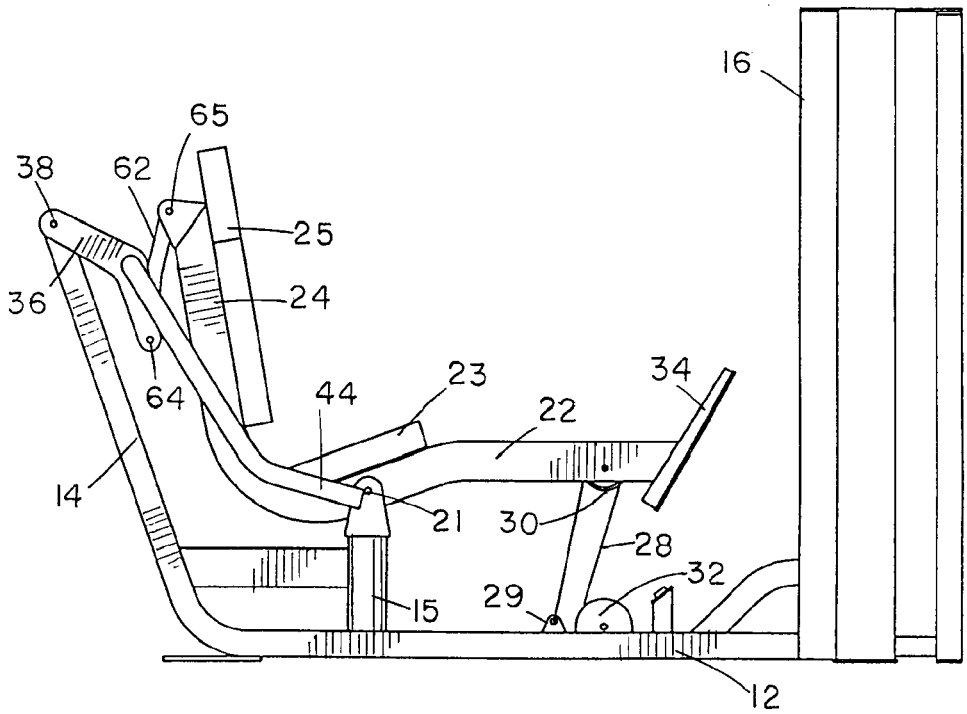
FIG. 10 is a side elevation view of the machine of FIG. 9, illustrating the exercise end position.

FIGS. 9 and 10 illustrate another modified triceps dip exercise machine which is similar to that of the first embodiment, but which has a modified connecting link between the exercise arm and user support. Other parts of the machine of FIGS. 9 and 10 are identical to the machine of FIGS. 1 to 6, and like reference numerals have been used as appropriate.

In the machine of FIGS. 9 and 10, the central portion of the U-shaped exercise arm is attached at an intermediate point or apex 60 of the pivoted plates 36. A connecting link 62 is pivoted at one end to the forward ends of the plates 36 via pivot 64, while the opposite end of link 62 is pivoted to the upper end of the back rest portion or upright 24 of the user support via pivot 65. Since the connecting link is attached to the user support at a location which is higher than the connection point on the exercise arm 35, pushing down on the exercise arm 35 to move it from the start position of FIG. 9 into the end position of FIG. 10 also pulls down the link 62, so that it pulls the user support 20 to rotate it rearwardly about pivot 21. Again, the exercise start and end positions are more or less identical to those of the first embodiment, and the exercise movement is the same.

Figure 11:
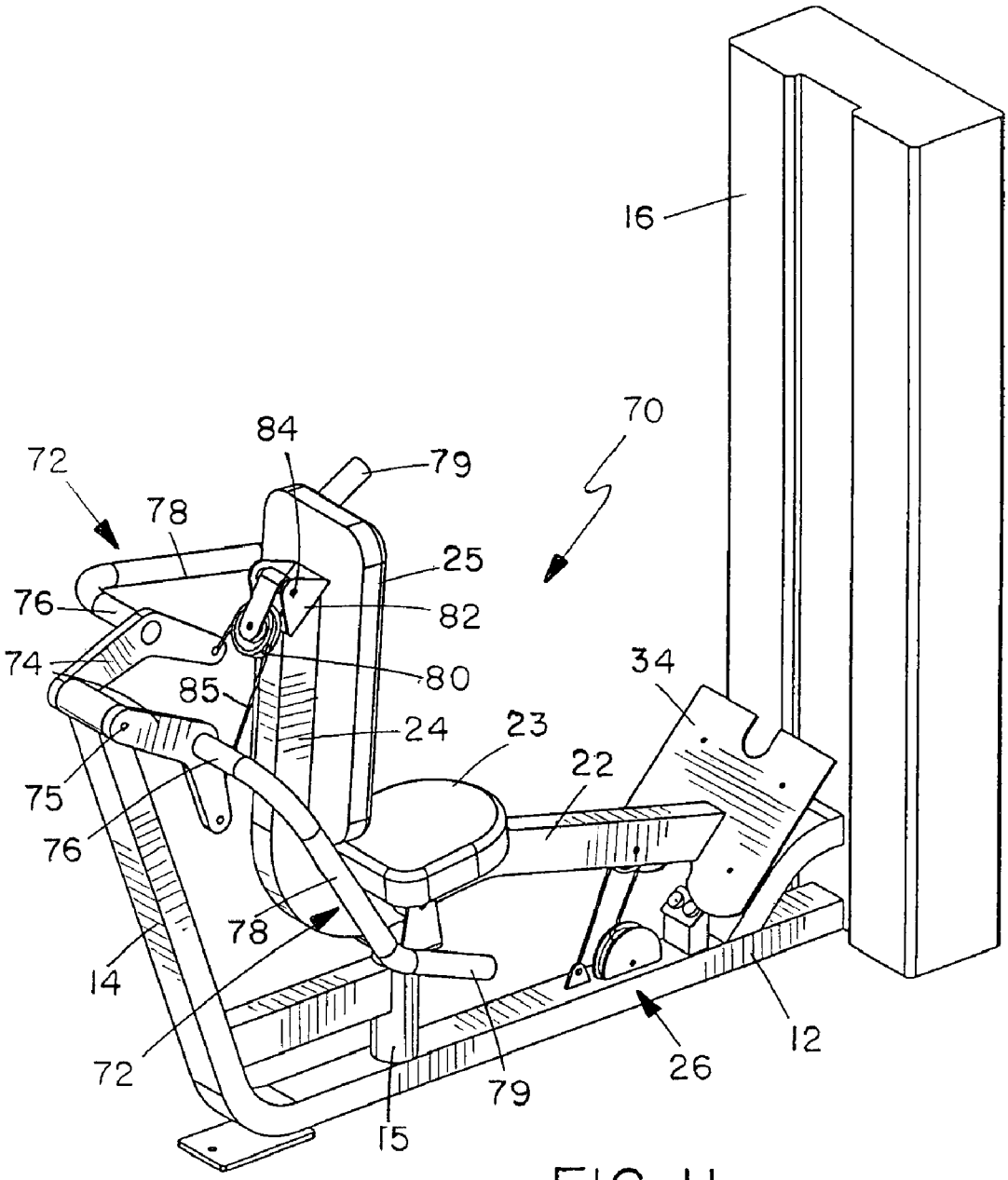
FIG. 11 is a rear perspective view of a modified triceps dip exercise machine with independent exercise arms.

FIG. 11 illustrates another modified triceps dip exercise machine 70 in which the single piece exercise arm of the previous embodiments has been replaced by a split, two-piece arm that provides unilateral or independent arm action, and the rigid connecting link of the previous embodiments is replaced by a cable and pulley linkage. Other parts of the machine are identical to the first embodiment, and like reference numerals are used as appropriate.

In the embodiment of FIG. 11, as in the first embodiment, a generally L-shaped user support frame 20 is pivotally mounted on a pivot mount 15 on the base 12 of the main frame via pivot 21, and linked to a weight stack in weight stack housing 16 via a cable and pulley assembly 26. In this embodiment, as noted above, the single exercise arm of the previous embodiments is replaced by separate exercise arms 72 for independent arm movement by the user. Each exercise arm has a rear pivot bracket 74 pivoted at one end to the upper end of the rear frame strut 14 via pivot 75, and an elongate arm portion having an inwardly curved rear end 76 secured to an intermediate point on the respective pivot bracket 74. Each arm has an extended portion 78 projecting forward from the rear end 76, and a handle 79 bent at a predetermined orientation at its forward end.

Each pivot bracket 74 is connected to the upper end of the user support upright 24 by a cable and pulley assembly. The cable and pulley assembly or linkage comprises a pulley 80 pivotally mounted on a pivot bracket 82 at the upper end of the user support upright 24 via pivot 84, and a flexible line or cable 85 reeved through the pulley 80 and connected to the forward ends of the exercise arm pivot brackets 74. When one or both of the exercise arms 72 is pushed downward, the line 85 pulls the user support rearward about its pivotal connection 21 to the main frame, towards the rearwardly reclined end position of FIG. 6. When both exercise arms are in the upper, start position illustrated for the rearmost arm in FIG. 11, the user support is in the forward inclined, start position of FIG. 5. When one arm is pressed downward, the line 85 pulls the user support rearward towards the end position of FIG. 6, with the user support ending-up moving half the distance towards the end position. If both arms are pressed downward simultaneously, the user support moves the full distance to the end position of FIG. 6. This arrangement provides equal resistance to each of the user's arms and provides a more balanced workout. It allows the user to work one arm at a time and requires more coordination when both arms are worked together. The one-piece exercise arm of any of the previous or following embodiments may be replaced by a split, two-piece arm as in FIG. 11 if desired.

Figure 12:
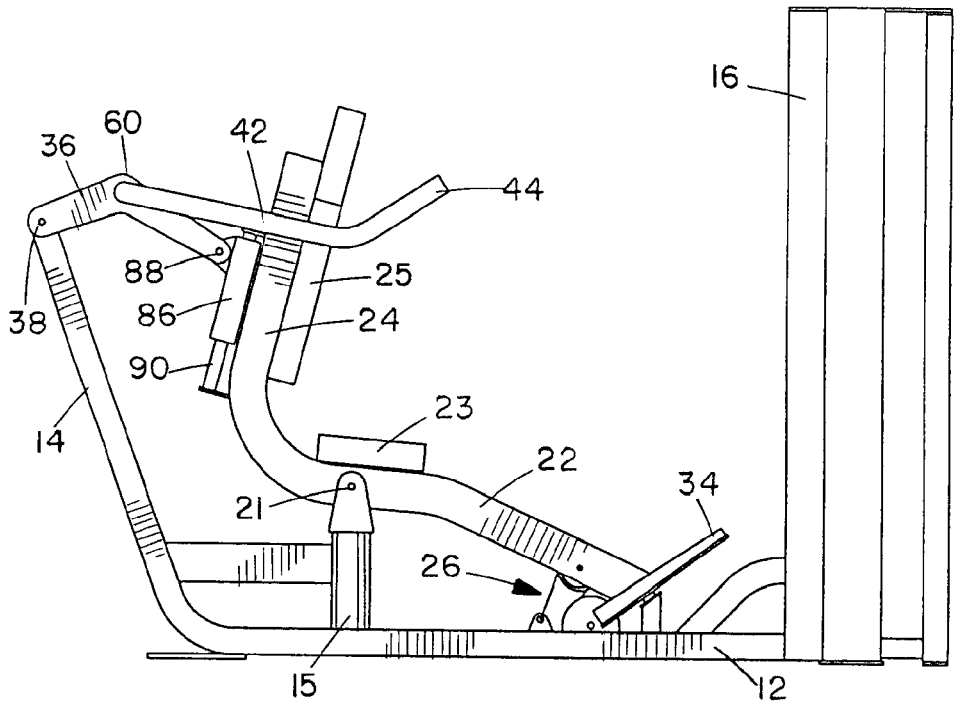
FIG. 12 is a side elevation view of a modified triceps dip exercise machine, illustrating the exercise start position.
Figure 13:
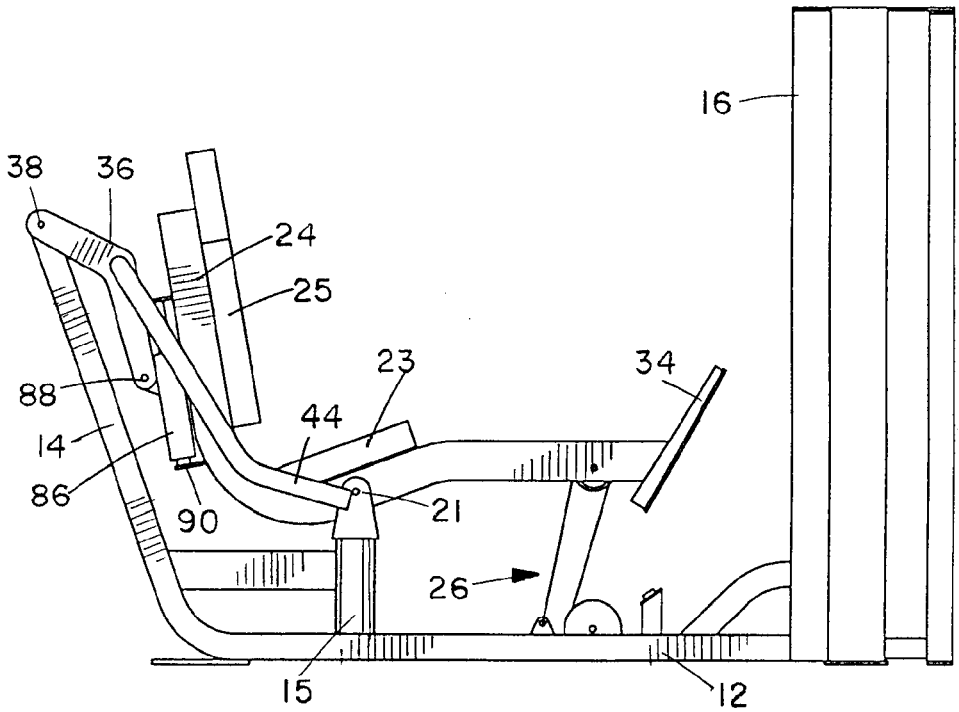
FIG. 13 is a side elevation view of the machine of FIG. 12, illustrating the exercise end position.

FIGS. 12 and 13 illustrate a modification of the exercise machine of FIGS. 9 and 10 where the connecting link 62 is replaced with a linear slide pivotally connected to the exercise arm. Other parts of the machine of FIGS. 12 and 13 are identical to parts in the first and second embodiments described above, and like reference numerals have been used as, appropriate.

In the embodiment of FIGS. 12 and 13, as in that of FIGS. 9 and 10, the central portion 40 of the U-shaped part of the exercise arm is secured to an intermediate point or apex 60 of the pivot plates 36. The forward ends of the exercise arm pivot plates 36 are pivotally connected to a linear slide 86 via pivot 88. The linear slide 86 runs on a guide bar 90 mounted on the rear side of the user support upright 24.

In the start position of FIG. 12, the exercise arm is in the same raised position and the user support is in the same forward inclined position as the previous embodiments, while the linear slide 86 is located at the upper end of the guide bar or track 90. As the exercise arm 35 is pushed downward, the slide 86, pivoting about its connection to the exercise arm, moves down the guide bar 90, pushing the user support to rotate rearward into the rearwardly reclined end position of FIG. 13. The start and end positions of the exercise arm and user support in this modified embodiment are the same as in the previous embodiments, and the exercise movement is also unchanged.

Figure 14:
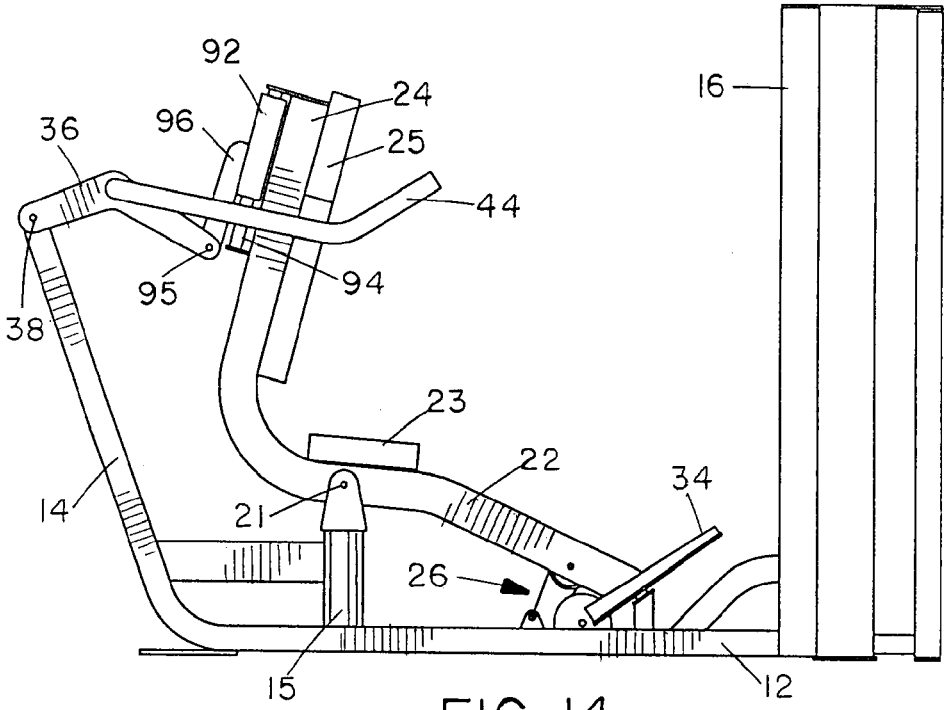
FIG. 14 is a side elevation view of a modified triceps dip exercise machine, illustrating the exercise start position.
Figure 15:
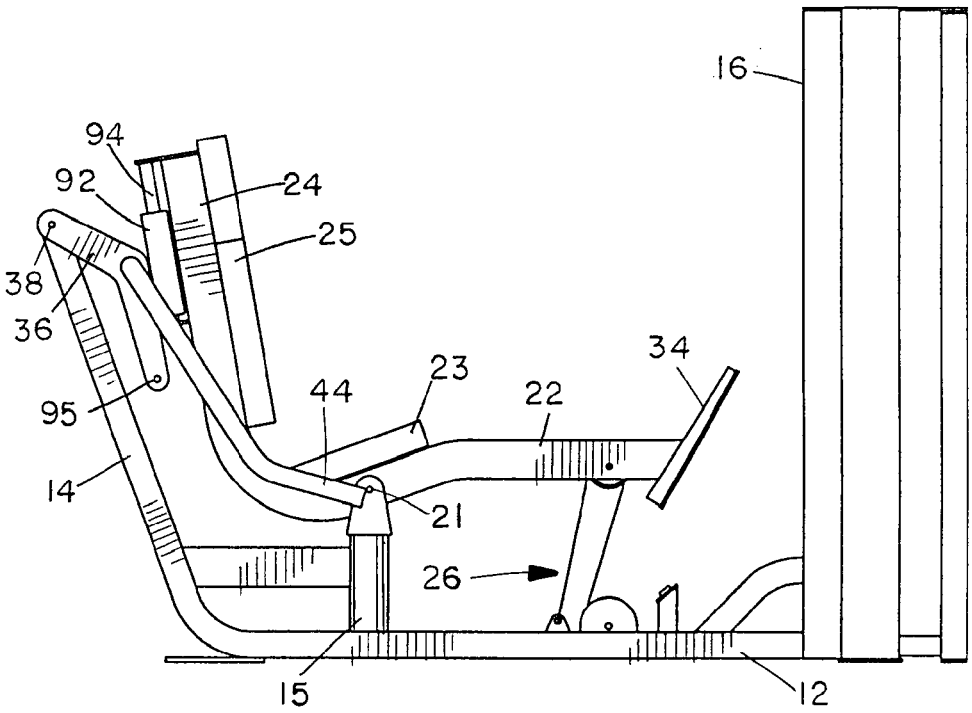
FIG. 15 is a side elevation view of the machine of FIG. 14, illustrating the exercise end position.

FIGS. 14 and 15 illustrate a modification of the machine of FIGS. 12 and 13, in which the position of the guide bar for the linear slide is changed. The parts are otherwise identical to the previous embodiment, and like reference numerals have been used for like parts as appropriate. In this embodiment, the exercise arm 35 is again linked to the user support 20 via a linear slide 92, but the position of the guide bar or track 94 on which the slide 92 runs is changed. In this case, the guide bar 94 of the connecting link is secured to the upper end of the user support upright 24, above the exercise arm. The forward ends of the exercise arm pivot plates 36 are pivotally connected via pivot 95 to an extension 96 extending from the slide 92. The slide member starts at the top of the guide bar 94 in the start position of FIG. 14. As the exercise arm is pushed down, the slide 92 is pulled down the guide bar 94, which pulls the user support, forcing it to rotate rearwardly. Thus, the only difference between the embodiment of FIGS. 14 and 15 and that of FIGS. 12 and 13 is that the user support is pulled, rather than pushed, into the rearwardly reclined end position of FIG. 15.

Figures 16, 17, 18:
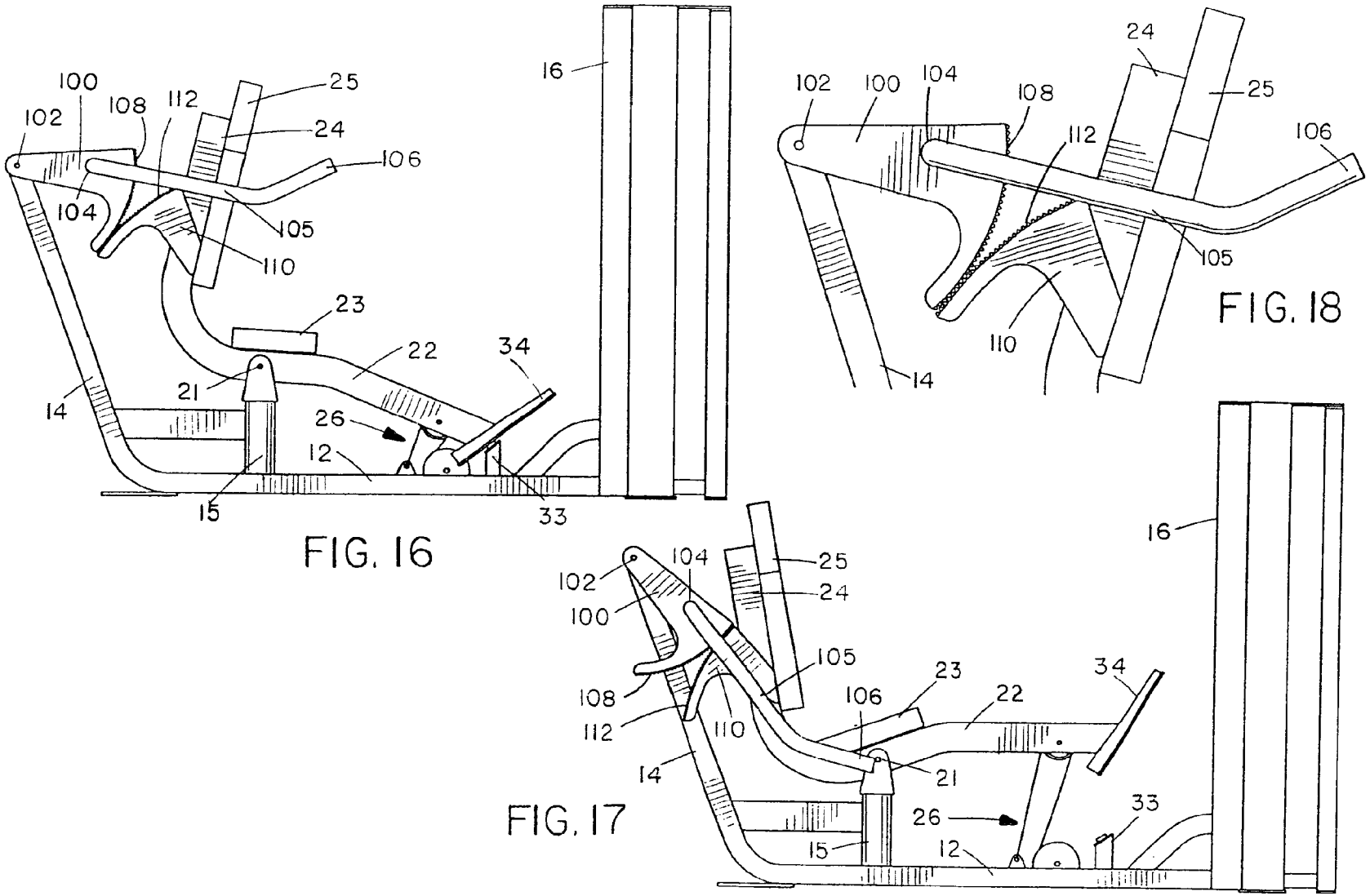
FIG. 16 is a side elevation view of a modified triceps dip exercise machine, illustrating the exercise start position.
FIG. 17 is a side elevation view of the machine of FIG. 16, illustrating the exercise end position.
FIG. 18 is a close-up view of the interlocking gears of the machine of FIGS. 16 and 17.

FIGS. 16 to 18 illustrate a modified version of the machine of FIGS. 1 to 6, in which geared cams are used in place of the pivoted connecting link 45 to translate downward motion of the exercise arm into rearward rotation of the user support. FIG. 18 is an enlarged view illustrating the interlocking gears of the connecting link of FIGS. 16 and 17 in more detail. The parts are otherwise identical to the first embodiment, and like reference numerals have been used as appropriate.

In this embodiment, one set of toothed gears is mounted on the exercise arm, while the other set of gears is mounted on the rear upright 24 of the user support. The exercise arm comprises a pair of parallel plates 100 with rear ends pivotally mounted on opposite sides of upright strut 14 via pivot pin 102, and a U-shaped arm having a central section 104 secured to plates 100, and opposite arms 105 projecting forwardly from plates 100 on opposite sides of the user support frame, with user engaging portions or handles 106 at the forward ends of arms 105. Plates 100 also each have a forward, curved gear tooth edge 108, and corresponding plates 110 are mounted on the rear of the user support frame with gear tooth edges 112 meshing with the gear teeth on the edges 108 of the plates 100. It can be seen that the matching gear-toothed cams 108, 112 translate downward movement of the exercise arm into rearward rotational movement of the user support frame, and comprise the connecting link between the exercise arm and user support. Again, the start and end positions and the exercise motion are all identical to that of the previous embodiments.

Figure 19:
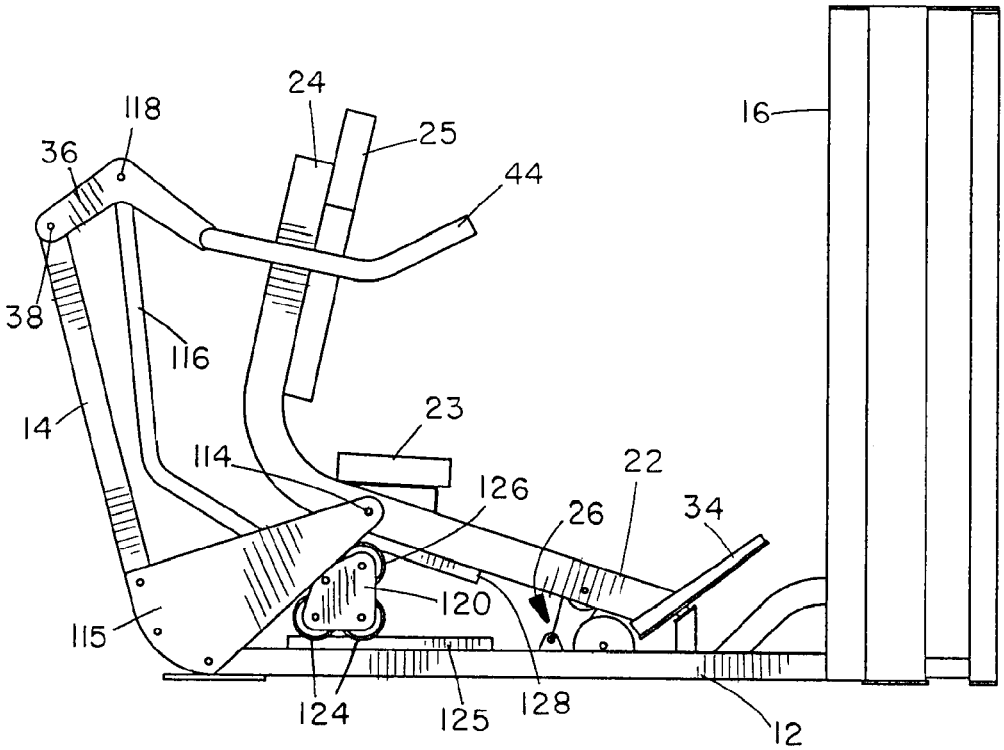
FIG. 19 is a side elevation view of a modified triceps dip exercise machine, illustrating the exercise start position.
Figure 20:
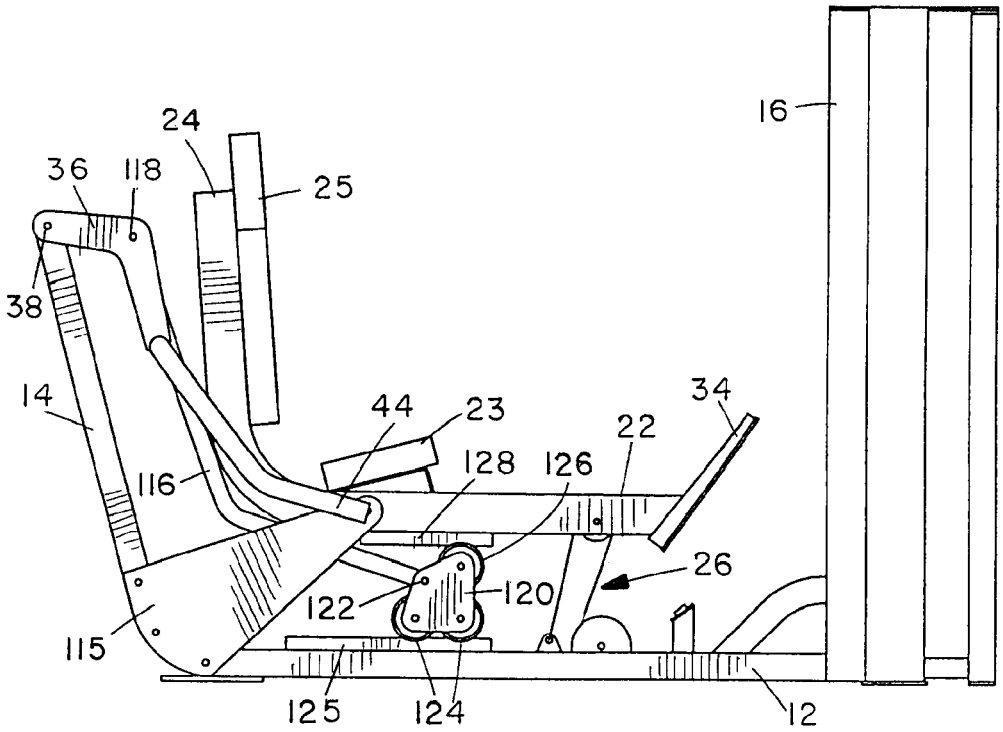
FIG. 20 is a side elevation view of the machine of FIG. 19, illustrating the exercise end position.

FIGS. 19 and 20 illustrate another modified exercise machine which has a modified, rolling wedge connecting link between the user support frame and exercise arm. The machine of FIGS. 19 and 20 is otherwise similar or identical to that of FIGS. 1 to 6, and like reference numerals have been used for like parts as appropriate. The exercise movement in this case is identical to that of FIGS. 1 to 6, with the user, user support, and exercise arm adopting the same positions as illustrated in FIGS. 5 and 6 in the exercise start and finish positions.

In the embodiment of FIGS. 19 and 20, as in the first embodiment, the exercise arm 35 has rear pivot plates 36 which are pivotally secured to the rear end of the frame rear upright 14 at pivot 38, and which have forward ends connected to the mid point of a U-shaped member with handles 44 at the opposite ends of its arms. The user support 20 is similar to that of the first embodiment but the base is straight rather than having a bent forward end portion. The user support 20 is pivotally supported via pivot 114 on the upper ends of spaced pivot mounting brackets 115 secured to the main frame at the junction between base 12 and upright 14. The pivot 114 is located under the seat pad, in an equivalent location to the previous embodiments. However, the pivot mount is changed in this embodiment to provide space for mounting the rolling wedge assembly, described in more detail below.

An angled connecting link or bar 116 is pivoted at one end to an intermediate point on the pivot brackets 36 via pivot 118, and extends in a downward direction and then forward between the pivot mounting brackets 115. The forward end of the link 116 is pivoted to a rolling wedge member 120 at pivot 122. The rolling wedge member has a first pair of rollers 124 in rolling engagement with a track or guide bar 125 on the frame base 12 and an upper roller 126 in rolling engagement with an inclined guide bar or track 128 located on the undersurface of the base 22 of the user support 20. This linkage is similar to that described in co-pending application Ser. No. 10/195,665 filed Jul. 12, 2002, the contents of which are incorporated herein by reference. In this embodiment, the straight base of the user support 20 provides for mounting of straight guide rail or track 128. The seat 23 is angled to duplicate the seat orientation in the previous embodiments.

As illustrated in FIG. 19, in the start position, the rolling wedge 120 is located towards the rear end of the guide tracks 125 and 128, and the exercise arm is in the raised, start position with the handles located just under the shoulders of a user seated on the user support seat pad with their back against back pad 25. This position of the exercise arm and user support is identical to the start position of FIG. 5. As the exercise arm is pushed downward to the finish position of FIG. 20, the pivot brackets 36 pivot downwardly and forward in a clockwise direction about pivot 38, simultaneously pushing the connecting link 116 forward. This forces the wedge 120 forward along the guide bars 125,128, which in turn pushes the base 22 of the user support upward so that the user support rotates rearwardly about its pivotal connection 114 to the main frame. This moves both the exercise arm and the user support into the end position of FIG. 20, which is equivalent to the end position of FIG. 6.

Figure 21:
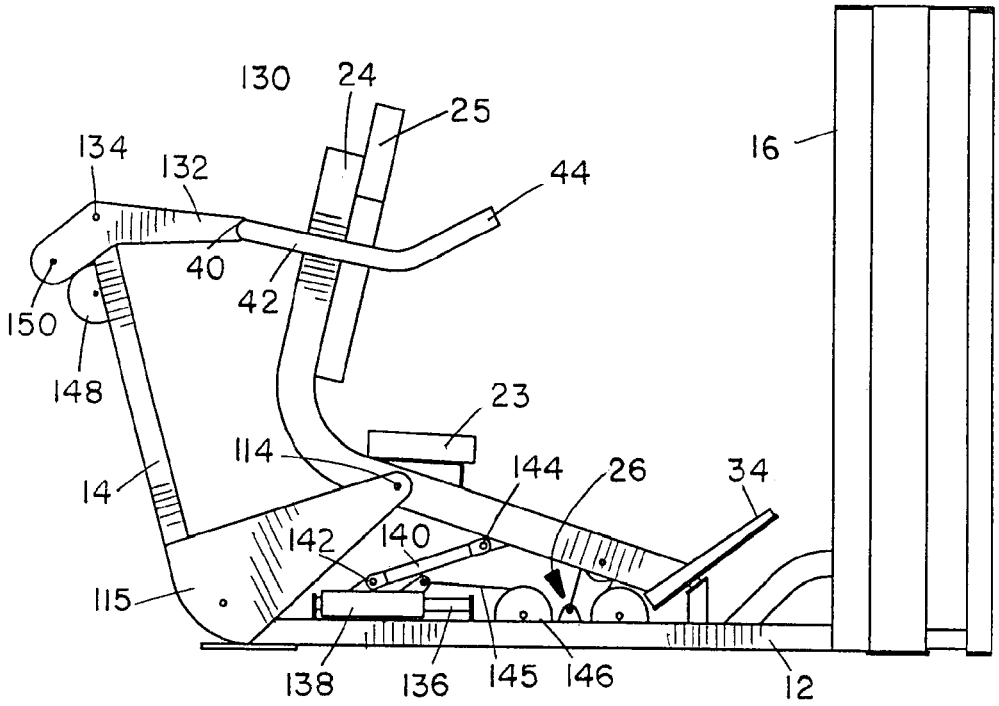
FIG. 21 is a side elevation view of a modified triceps dip exercise machine, illustrating the exercise start position.
Figure 22:
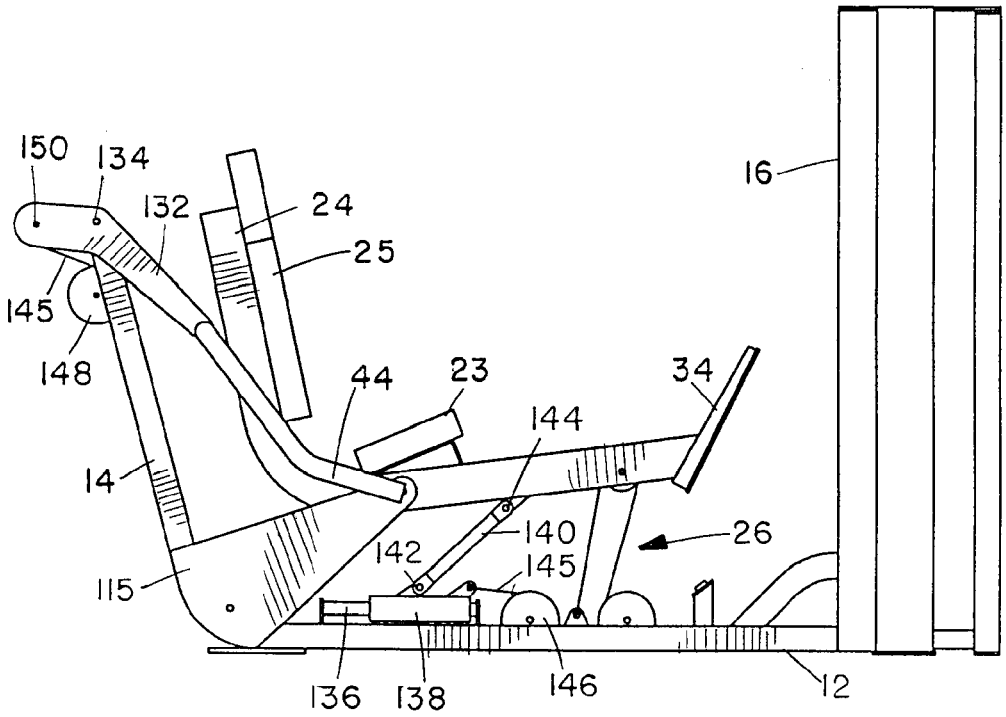
FIG. 22 is a side elevation-view of the machine of FIG. 21, illustrating the exercise end position.

FIGS. 21 and 22 illustrate: an exercise machine according to another embodiment of the invention, which has a modified connecting linkage between the exercise arm and the user support frame. Other parts of the machine are the same as in previous embodiments, and like reference numerals have been used for like parts as appropriate.

In this case, the user support pivot mount is identical to that of FIGS. 19 and 20, comprising a pair of spaced pivot mounting plates or brackets 115, with the user support pivotally mounted at the upper, forward ends of the plates via pivot pin 114, with the pivot connection located beneath the user seat pad 23 of the user support base 22. The exercise arm 130 is slightly modified from the previous embodiments, having a pair of rear pivot plates or brackets 132 which are pivoted at a location spaced from their rear ends to the frame upright 14 via pivot 134, and connected to the central portion 40 of a U-shaped member which is identical to the U-shaped member of some of the previous embodiments and has angled handles 44 at its forward ends. However, in this case, the rear ends of the exercise arm pivot brackets 132 are linked to the user support via a sliding linkage system 135. This sliding linkage system is similar to the one described in co-pending application Ser. No. 10/171,236 filed Jun. 12, 2002, the contents of which are incorporated herein by reference.

The sliding linkage system 135 includes a guide bar 136 mounted on top of the base section 12 of the main frame, and acting as a runner for a slide member 138, which may be a linear bearing, wheel, or the like. A connecting link 140 is pivotally connected at its first end to the slide member via pivot 142, and at its second end to the underside of the elongated base section 22 of the user support via pivot 144. The exercise arm 130 is connected to the slide member 138 by a cable and pulley system comprising a cable 145 having-a first end anchored to the slide member, and extending around a first pulley 146 on the base 12 of the frame at a location spaced in front of the guide bar 136, then back through the base 12 and around a pulley (not visible in the drawings) mounted at the junction between the base 12 and upright 14 of the frame. From this pulley, the cable extends along rear upright 14, and around a pulley 148 mounted on the upper end of frame upright 14 before being anchored to the pivot brackets 132 of the exercise arm 130 at a point 150 at the rear end of the brackets, spaced rearwardly from the exercise arm pivot 134.

As illustrated in FIG. 21, in the start position of the exercise arm and user support, the slide member 138 is at the rear end of the guide bar 136. The exercise arm and user support are in exactly the same positions as in the first embodiment, and support the user in the same position as illustrated in FIG. 5. The user sits on the user support with their hands gripping handles 44, and then pushes downward to rotate the exercise arm 130 downward and rearward about pivot 134 into the finish position of FIG. 22. In this position, which is equivalent to the end position of FIG. 6, the user's arms extend downward and are generally in line with the side centerline of their body. At the same time, downward and rearward movement of the exercise arm pulls up the rear end of brackets 132, simultaneously pulling up the cable 145. This movement translates into forward movement of the slide member 138, since the cable 145 pulls the slide member forwards. This causes the connecting link 140 to pivot about its connection to the slide member and user support. This action forces the user support to lift and rotate rearward about its pivot connection 114 to the main frame. Thus, the user support tracks movement of the exercise arm in exactly the same path as the previous embodiments, guiding and supporting the exerciser to maintain the proper body positioning and alignment throughout the exercise.

FIGS. 23 to 26 illustrate a triceps dip exercise machine 160 according to another embodiment, in which the user support frame is lifted-upward and rearward by a four bar linkage system. The user support 20 is identical to the first embodiment, and like reference numerals have been used as appropriate. However, the user support pivot mount, exercise arm, and connecting link between the user support and exercise arm are all modified, as described in more detail below, and the main frame has additional support struts. In this embodiment, the user support pivot mounting as well as the connecting link are both provided by the four bar linkage system.

The main frame of the exercise machine has a base 12, rearwardly inclined rear upright 14, and weight stack housing 16 at its forward end, as in the first embodiment. The frame also has a forward and upwardly inclined support strut 162 projecting upwardly from an intermediate point on the rear upright 14 towards the rear upright 24 of the user support, and a second, rearwardly inclined support strut 164 extending from the base 12 and connected to the first support strut 162. The central portion 179 of U-shaped exercise arm 180 is welded to ends of a pair of T-shaped pivot mounting brackets 175 which are pivoted to the rear frame upright 14 at pivot 178. Arm 180 has handles at its ends for gripping by an exerciser. The user support 20 is pivotally connected to the main frame by a first link 165 which runs from the top of the back section or rear upright 24 to the top of the first support strut 162, via first and second pivots 166 and 168, respectively. A second, longer connecting link 170 with an upward bend 172 adjacent a first end is pivotally connected at the first end to the elongated base or seat section 22 of the user support via pivot 174, located just in front of the seat pad 23, and at the second end to a third, short connecting link 181 via pivot 183, visible in FIGS. 26 and 26. The second connecting link 170 is also pivoted to the first support strut 162 below the pivotal connection 168 of the first link 165 via pivot 177, at a location between the two ends of the second link 170. The short, third connecting link 181 is pivoted at its opposite end to One end of the T-shaped pivot mounting brackets 175 of the exercise arm via pivot 176. This link therefore pivotally connects the exercise arm mounting brackets with the rearward ends of the second connecting link 170.

Figure 23:
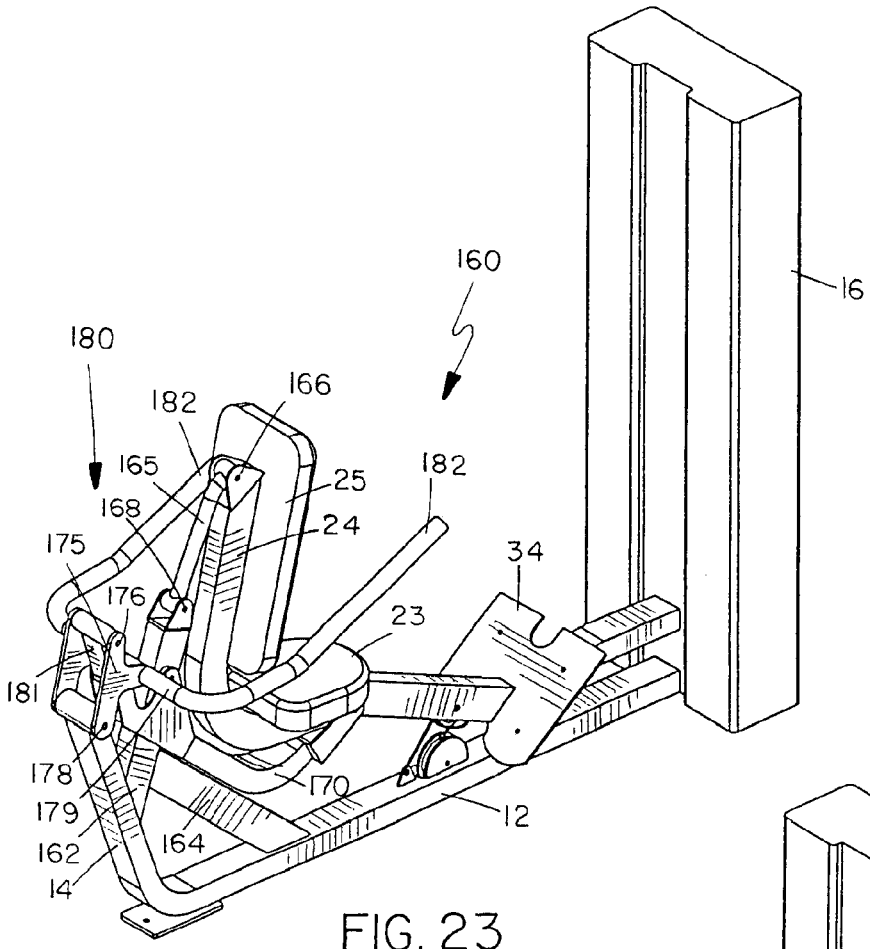
FIG. 23 is a rear perspective view of a triceps dip exercise machine according to another embodiment, illustrating the exercise start position.
Figure 24:
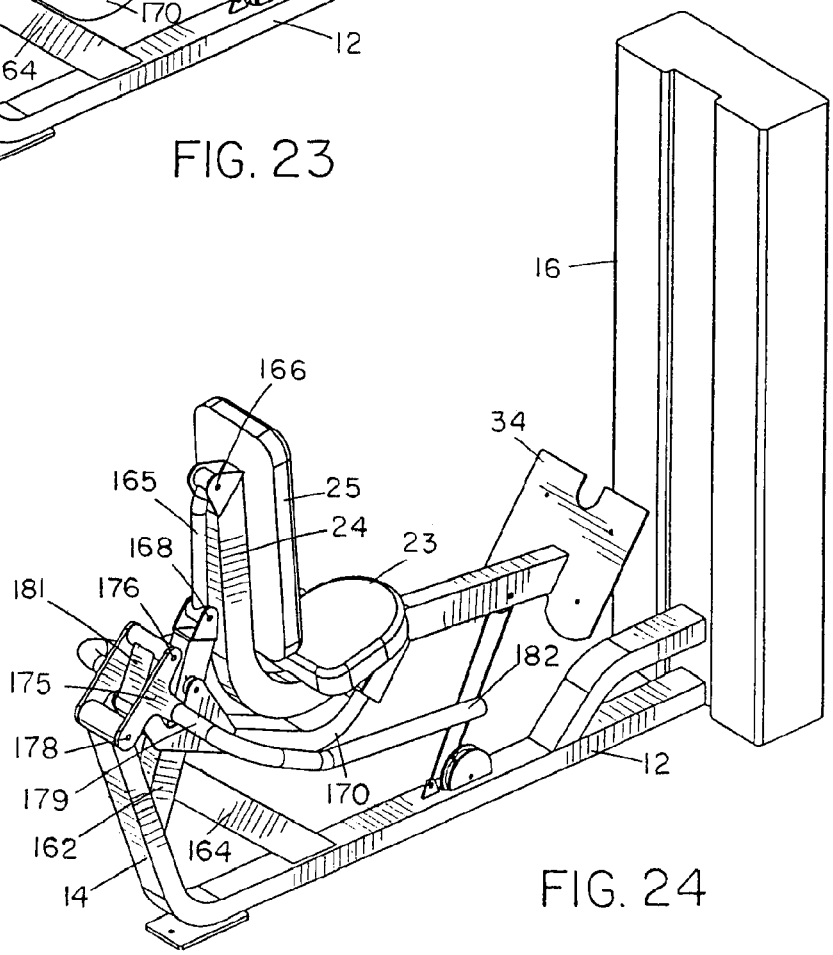
FIG. 24 is a rear perspective view of the machine of FIG. 23, illustrating the exercise end position.
Figure 25:
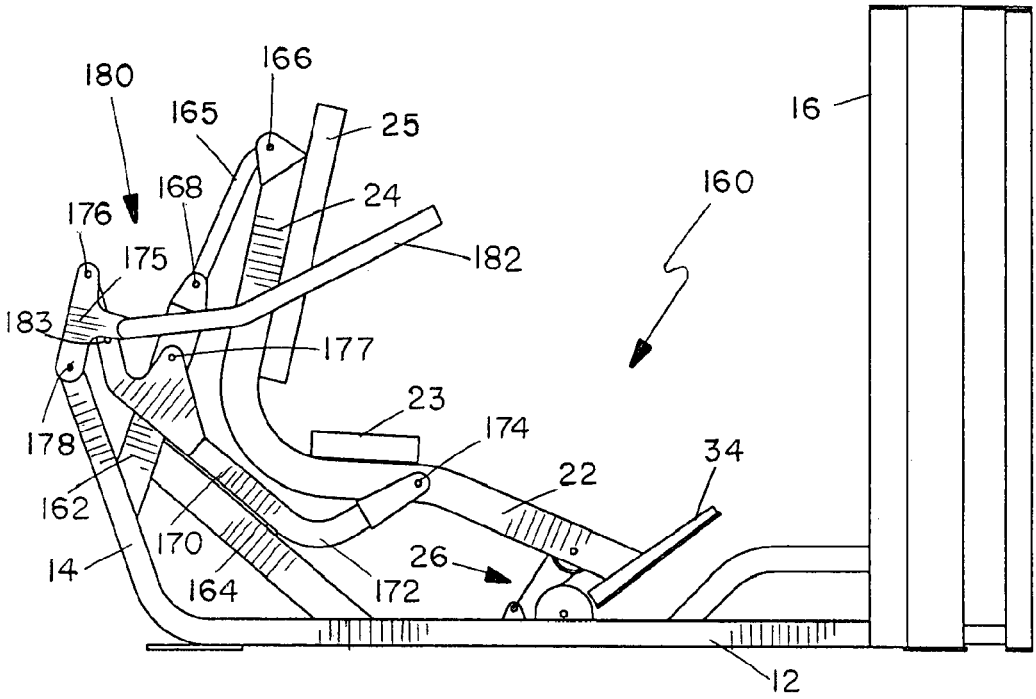
FIG. 25 is a side elevation view of the machine of FIG. 23, also illustrating the exercise start position.
Figure 26:
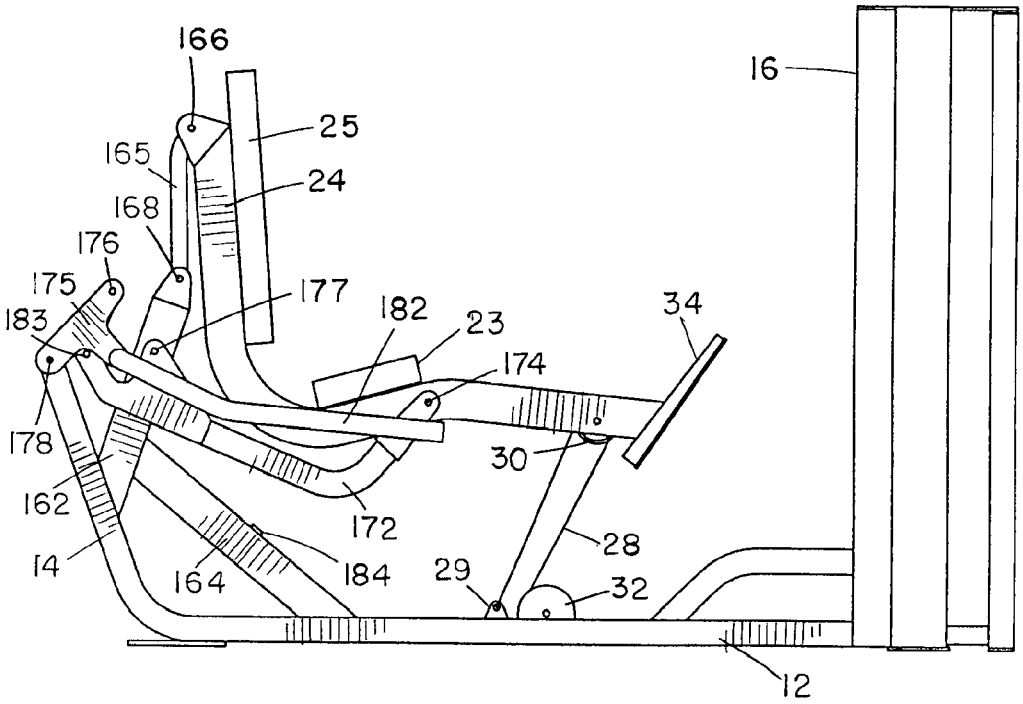
FIG. 26 is a side elevation view of the machine of FIGS. 23 to 25, illustrating the exercise end position.

The exercise arm and user support are illustrated in the start position in FIGS. 23 and 25. It can be seen that, in this position, the second connecting link 170 lies on the upper surface of the frame support strut 164, which has a stop or support pad 184 for preventing damage to the link 170 in this position. Also, the seat orientation and the handle position in the start position is equivalent to that in the start positions of the previous embodiments. The user seated on the user support is in a forward inclined orientation, and grips the handles in an equivalent position to that illustrated in FIG. 5 for the first embodiment.

When the exercise arm 180 is pushed downward from the start position of FIGS. 23 and 25, the third connecting link 181 forces the second connecting link 170 to rotate about its pivotal connection 177 to the main frame, which lifts the user support. As the user support is lifted, the first connecting link 165 forces it to tilt rearward. The combined action of the three connecting links results in a rearward rotation of the user support, similar to the movement found in the previous embodiments. Because this version causes the user support to lift and then tilt rearward, the elongated seat section 22 is raised slightly higher in the end position, causing more cable to be pulled. This can be seen by comparison of FIG. 6 with FIG. 26. This increases the amount of resistance felt by the user, relative to the amount of travel in the exercise arm, as compared with the previous embodiments. As in the previous embodiments, an optimum alignment relationship is maintained between the exerciser positioned on the user support and the user engaging handles on the exercise arms, throughout the exercise movement, because of the automatic self-alignment of the user support to the movement of the exercise arm. The combined motion of the seat and exercise arm provides a safer, more natural feeling exercise motion, and makes the exercise more fun to perform.

Figure 27:
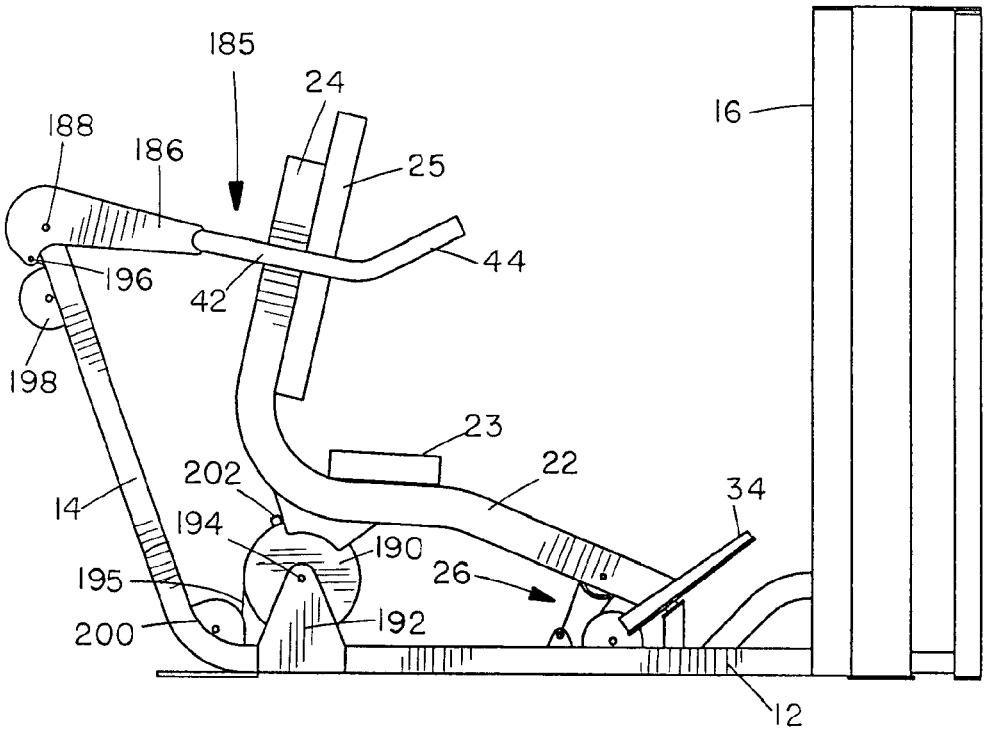
FIG. 27 is a side elevation view of another modified triceps dip exercise machine, illustrating the exercise start position.
Figure 28:
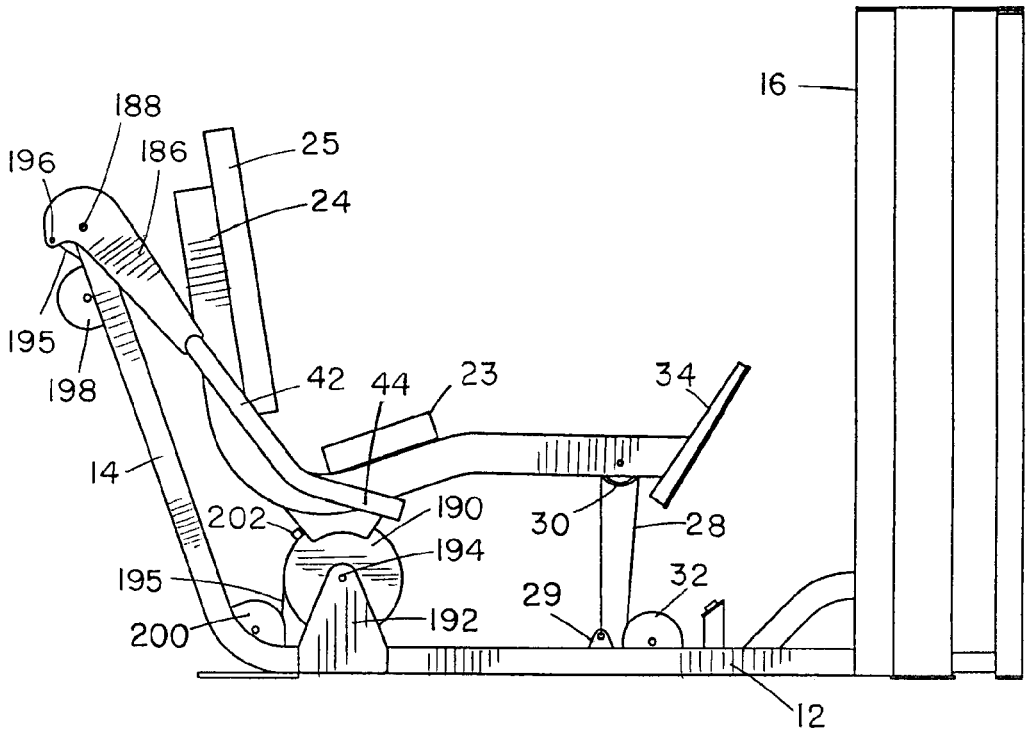
FIG. 28 is a side elevation view of the machine of FIG. 27, illustrating the exercise end position.

FIGS. 27 and 28 illustrate another triceps dip exercise machine with a modified user support mount and connecting link between the exercise arm and user support. Other parts of the machine are identical to those in previous embodiments, and like reference numerals have been used as appropriate.

In this embodiment, the main frame and user support are identical to the first embodiment, while the exercise arm 185 is similar to the embodiment of FIGS. 1 to 6 but has pivot brackets 186 of a different shape. The remainder of the exercise arm 185 is identical to the first embodiment, comprising a U-shaped member having a central portion connected to the forward ends of brackets 186 and forward projecting handle arms 42 extending on opposite sides of the user support, with bent handles 44 at their ends. The pivot brackets 186 are pivotally mounted at the upper end of the frame rear upright 14 via pivot 188, at a location adjacent but spaced from their rounded rear ends. As in the first embodiment, the user support frame 20 has a base or-extended seat portion 22 on which seat pad 23 is mounted, a rear upright 24 on which a back pad 25 is mounted, and a foot plate or support 34 at the forward end of base 22. The base of the user support frame is linked to the weight stack via a cable and pulley system 26 as in the first embodiment.

The user support is secured to a round cam 190 which in turn is pivotally mounted on a pivot mount 192 on the base 12 of the main frame via pivot 194. This replaces the direct pivot mount of the user support as in the first embodiment. The exercise arm 185 is linked to the round cam 190 via a cable and pulley system comprising a cable 195 extending from anchor 196 at the rear end of exercise arm pivot brackets 186, around a pulley 198 adjacent the upper end of the frame rear upright 14, and then reeving around a pulley 200 at the junction between frame upright 14 and base, 12, before extending to an anchor 202 on the round cam.

The start position of the machine is illustrated in FIG. 27. As in the previous embodiments, the user sits on the user support seat in the start position, and grips the handles 44 which are positioned just below their shoulders, in an equivalent position to that illustrated in FIG. 5. They then push the handles 44 downward, rotating the exercise arm 185 downwardly and rearwardly about pivot 188. This in turn pulls cable 195 upwardly, which forces the round cam 190 to rotate in an anti-clockwise direction, causing the user support 20 to pivot rearward into the end position of FIG. 28. Again, the exercise movement is identical to the previous embodiments, with the user supported in the proper orientation throughout the exercise and aligned to the position of the exercise arm throughout the entire travel path.

Figure 29:
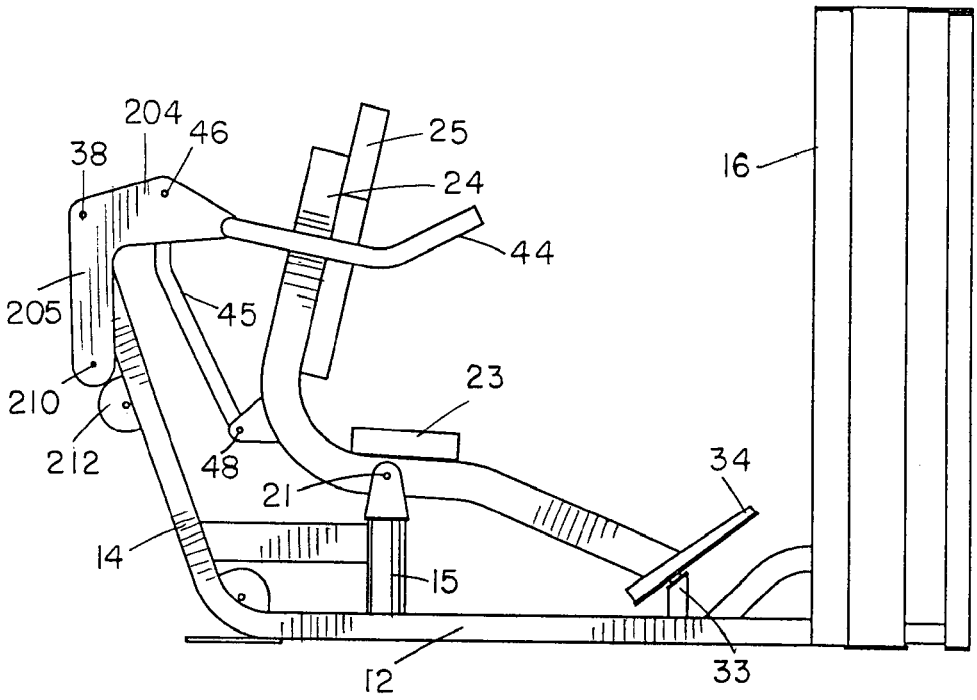
FIG. 29 is a side elevation view of a modified triceps dip exercise machine, illustrating the exercise start position.
Figure 30:
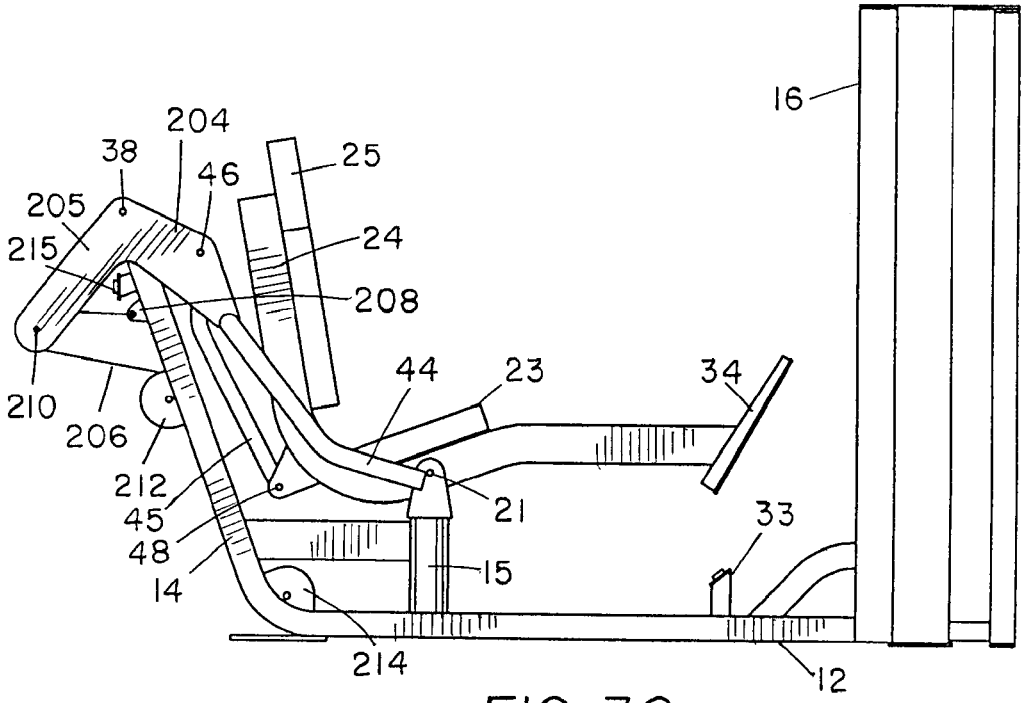
FIG. 30 is a side elevation view of the machine of FIG. 29, illustrating the exercise end position.

FIGS. 29 and 30 illustrate an exercise machine with the same connecting link between the exercise arm and user support as the first embodiment, but in which the exercise arm, rather than the user support, is linked to the resistance (in this case a selectorized weight stack in housing 16). Again, some parts of the machine of FIGS. 29 and 30 are identical to parts in FIGS. 1 to 6, and like reference numerals are used as appropriate. In this case, the pivot mounting brackets 204 of the exercise arm are modified to provide a downward or angled extension 205 beyond pivot 38. The cable and pulley linkage 26 from the user support to the weight stack is eliminated, and the end of extension 205 of the exercise arm pivot brackets is instead linked to the weight stack via a cable 206 extending from an anchor 208 on the rear side of the frame upright 14, around a pulley on the end of extension 205 having a pivot axle 210, and then around an upper pulley 212 on the rear upright 14, a pulley 214 at the junction between the upright 14 and the base 12, and then through the base 12 into the weight stack housing 16, where it is suitably linked to the weight stack. A raised stop pad 215 on the rear upright 14 adjacent the cable anchor 208 engage a cross panel or strut (not visible in the drawings) extending between the two pivot brackets 204 when the arm is in the start position of FIG. 29, avoiding any risk of damage to the pulley at the end of extension 205 when the arm is released.

In this embodiment, the exercise arm is pivotally connected to the frame upright 14 at a location between the user engaging end or handles 44 and the resistance attachment end, while the connecting link 45 is pivotally connected to the exercise arm at a location between the user engaging end or handles 44 and the pivotal connection 38 to the main frame. In the start position of FIG. 29, the exercise arm and user support are in the same relative positions and orientations as in the first embodiment. A user seated on the user support 20 grips the handles 44 of the exercise arm in the same way as illustrated in FIG. 5, and then pushes down on the handles. This forces the exercise arm to pivot about its pivotal connection 38 to the main frame, lifting the end of extension 205 upward and outward, pulling the cable 206 and lifting the selected weights in the weight stack. At the same time, the pivotal connecting link 45 forces the user support to pivot from the start position of FIG. 29 to the end position of FIG. 30, in which the exercise arm is also in the lowered, end position, both end positions being equivalent to those illustrated in FIG. 6 for the first embodiment.

Figure 31:
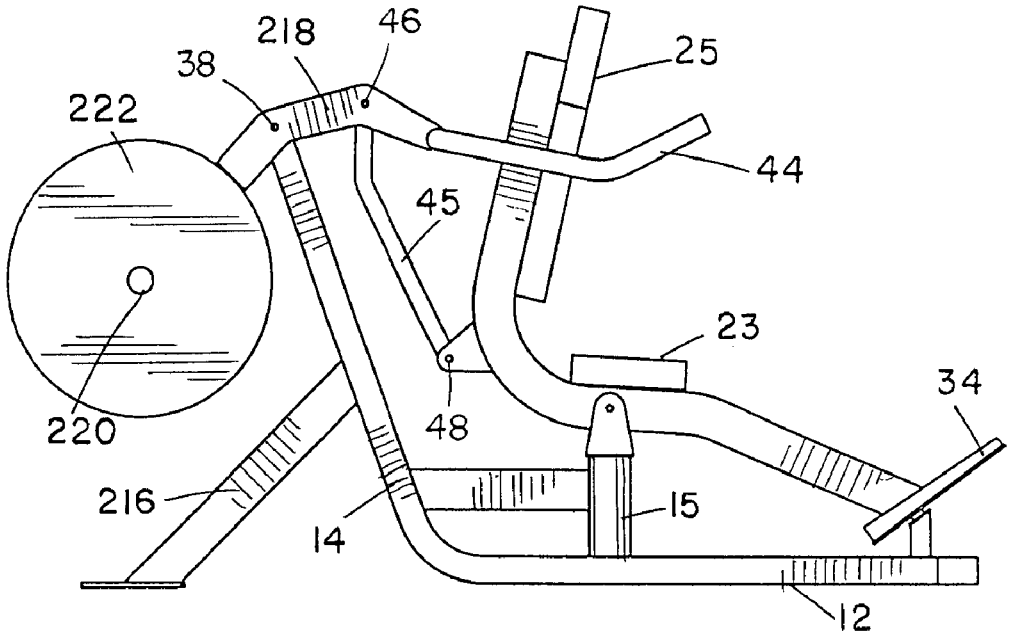
FIG. 31 is a side elevation view of a modified triceps dip exercise machine, illustrating the exercise start position.
Figure 32:
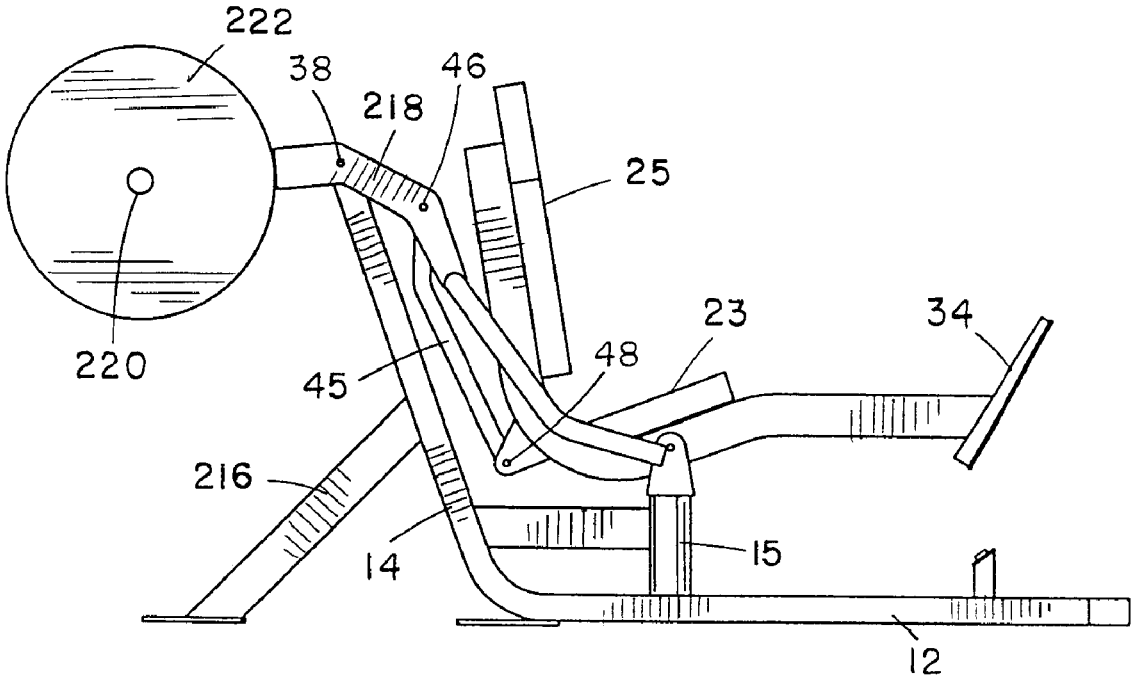
FIG. 32 is a side elevation view of the machine of FIG. 31, illustrating the exercise end position.

FIGS. 31 and 32 illustrate a modification of the previous embodiment in which the weight stack exercise resistance is replaced by hand-loaded weight plates. Other parts of the machine are identical to the previous embodiment, and like reference numerals are used as appropriate. In this embodiment, an additional, inclined support strut 216 is provided at the rear of the frame, and is secured to the rear upright 14 at a location spaced between the ends of upright 14, to resist rearward tipping of the frame when the user exits the machine. The exercise arm has modified pivot brackets 218 which are each extended generally rearwardly from the pivotal connection 38 to frame upright 14, and have oppositely directed weight pegs 220 at their rear ends. A selected number of weight plates 222 may be loaded on pegs 220, dependent on the amount of exercise resistance desired by the user. The operation of the machine with a plate-loaded exercise arm as in FIGS. 31 and 32 is identical to that of the previous embodiment, with the equivalent start and end positions, as can be seen by comparison of FIGS. 31 and 32 with FIGS. 29 and 30, respectively.

Figure 33:
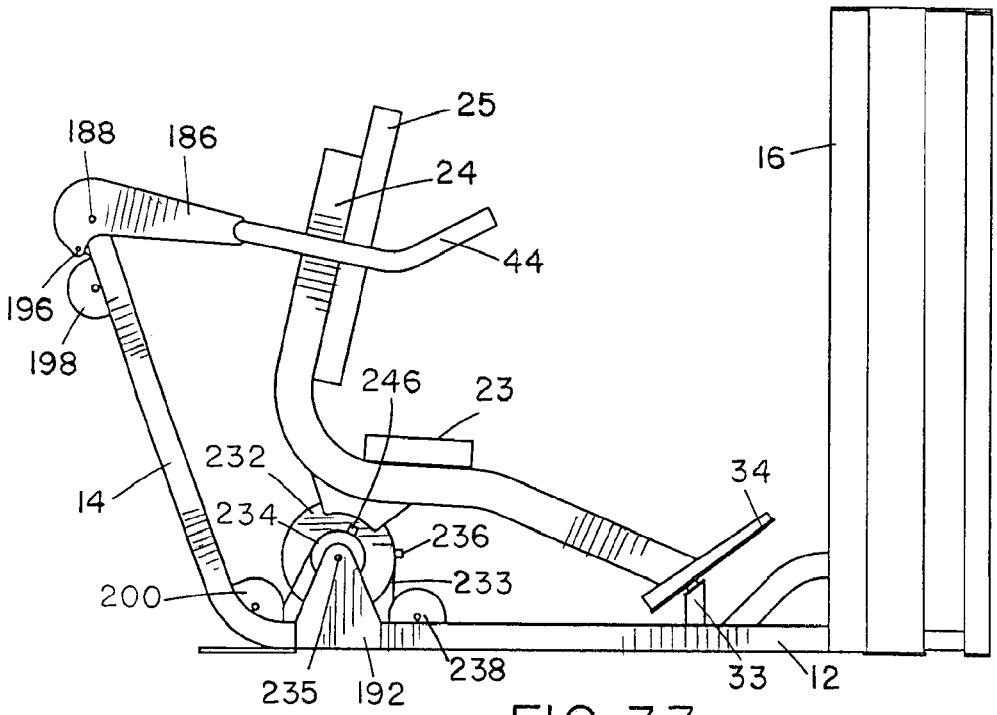
FIG. 33 is a side elevation view of a modified triceps dip exercise machine, illustrating the exercise start position.
Figure 34:
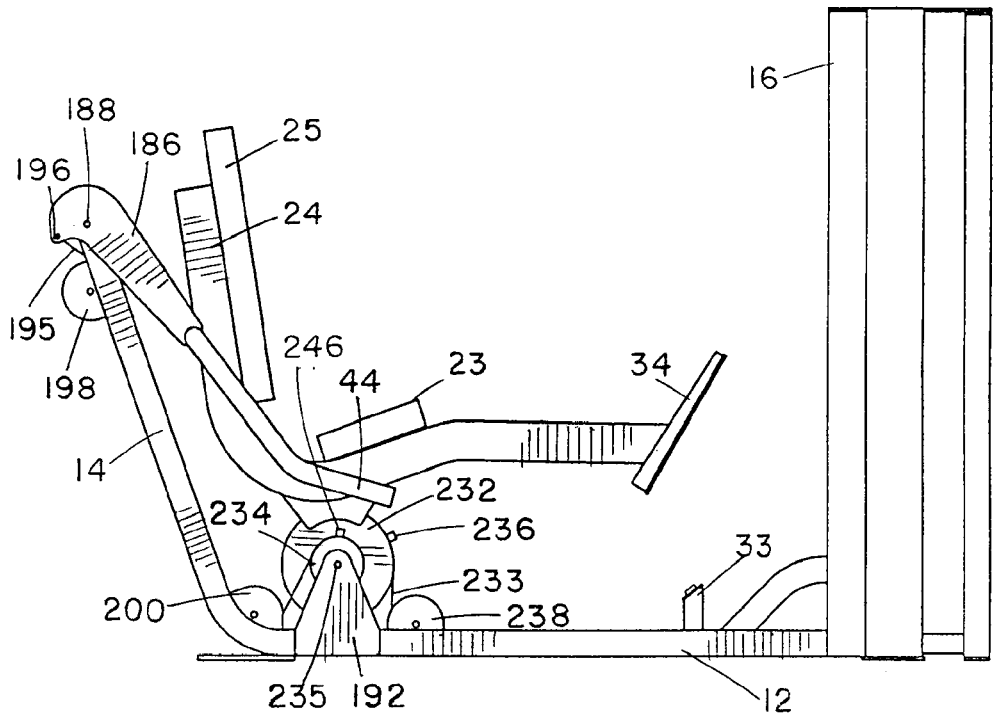
FIG. 34 is a side elevation view of the machine of FIG. 33, illustrating the exercise end position.

FIGS. 33 and 34 illustrate a modified triceps dip exercise machine which is similar to that of FIGS. 27 and 28, but replaces the single cam mount for the user support with a double cam. The double cam comprises a first, larger user support cam 232 and a smaller cam 234 which is linked to the exercise arm. At least the first, user support cam is mounted on rotating pivot shaft 235 on pivot mount 192, while the second, smaller cam may be attached to the user support cam 232, or may be fixedly attached to the same pivot shaft 235 as the user support cam, so that the cams 232,234 rotate in unison. The user support 20 is fixedly attached to the user support cam 232, and the cam 232 in turn is linked to the weight stack in housing 16 via a cable 233 extending from anchor 236 on the cam 232, and around a pulley 238 on the base 12 of the main frame, before extending into the weight stack housing and linking to the weight stack in a conventional manner. The exercise arm 185 in this case is identical to the exercise arm of FIGS. 27 and 28, and is linked to the second, smaller cam 234 via cable 195 extending from an anchor point 196 at the rear ends of the brackets 186, around a first pulley 198 on the rear upright strut 14, around a further pulley 200 mounted at the junction between the rear strut 14 and base 12 of the main frame, and then connecting to an anchor 246 on the smaller cam 234.

The start and finish positions of this modified machine are illustrated in FIGS. 33 and 34, respectively, and it can be seen that the exercise arm and user support correspond in orientation and relative positions to the start and finish positions of all of the previous embodiments. The user seated on user support 20 in the start position of FIG. 33 pushes down on handles 44, rotating the exercise arm 185 downwardly and: rearwardly about pivot 188. This pulls on cable 195, rotating the smaller cam 234 in a counter-clockwise direction and causing a similar rotation of the larger cam 232, such that the user support 14 is rotated about the pivot axis of pivot shaft 235 into the more rearwardly reclined, end position of FIG. 34. Rotation of cam 232 in turn pulls the resistive cable 233, lifting the selected weights in the weight stack.

FIGS. 35 to 38 illustrate a triceps dip exercise machine 250 according to another embodiment, in which the rotatably mounted exercise arm of the previous embodiments is replaced with a linear movement exercise arm. Machine 250 has a main frame with a base 252, a forward inclined rear strut 254, a user support mount or pivot mount 255 on the base 252, and a strut 256 extending rearwardly from the mount 255 and connected to the inclined rear strut 254 at a location spaced a short distance above the junction between the rear strut 254 and the base 252. A weight stack housing 16 identical to the first embodiment is provided at the forward end of the frame. A pair of guide bars 258 are mounted on the forward or inner side of the inclined strut 254, and an exercise arm 260 comprising a U-shaped member has a central portion 262 secured to linear bearings 264 which are slidably mounted on guide bars 258. The linear bearings 264 may be replaced with wheels, bushings, or any other linear movement device known in the art. Exercise arm 260 has handle portions 265 at its ends which are bent at an appropriate angle for gripping by a user 266 as illustrated in the start position of FIG. 37.

Machine 250 has a user support frame 20 substantially identical to the previous embodiments, and like reference numerals have been used as appropriate. User support frame 20 is generally L-shaped with a base 22 on which a seat pad 23 is mounted, and an upright 24 on which back pad 25 is mounted. The user support frame is pivotally mounted on the frame pivot mount 255 via pivot pin 270. The base 22 of the user support frame is linked to the weight stack via a cable and pulley system 26 identical to that of FIGS. 1 to 6. A pulley 272 is mounted at the upper end of the user support upright 24. A cable 274 has a first end connected to the sliding linear bearings 264 of the exercise arm, and is reeved around the pulley 272 before being connected at its second end to an anchor 275 at the upper end of the inclined strut 254.

Figure 37:
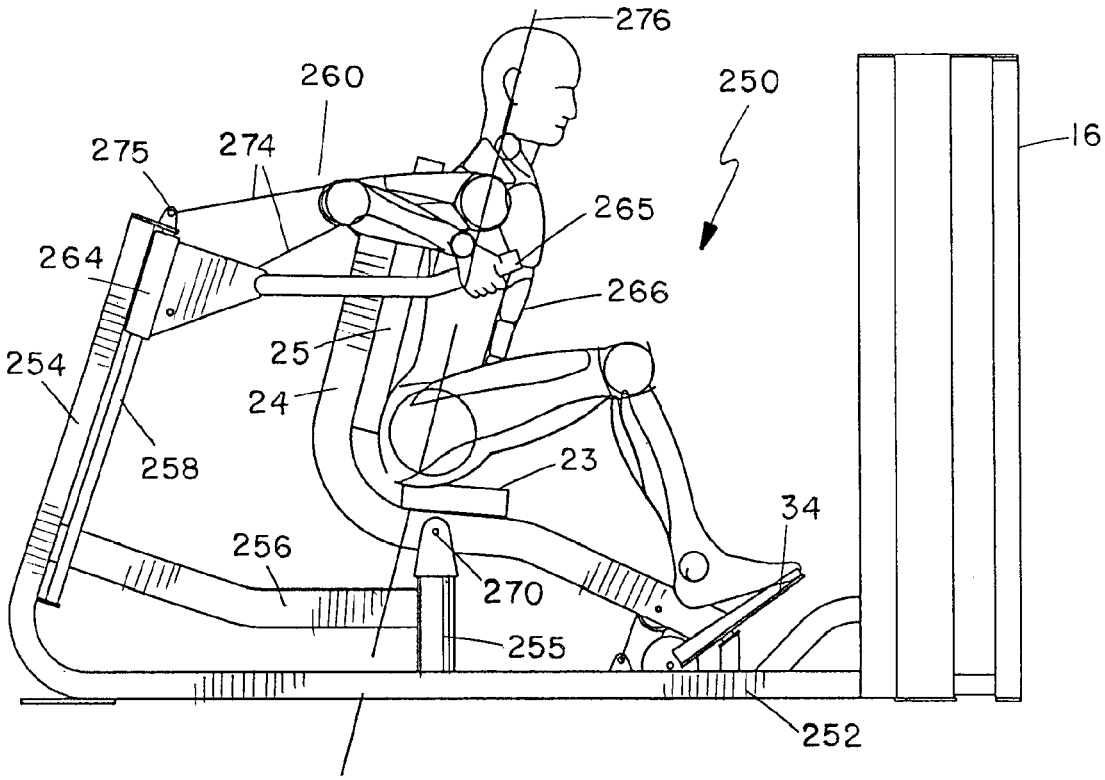
FIG. 37 is a side elevation view of the machine of FIGS. 35 and 36, illustrating an exerciser seated in the user support in the exercise start position.

FIG. 37 illustrates the user 266 in a start position seated on the user support seat pad 23 and leaning against back pad 25, with their hands gripping the exercise arm handles 265 at a forward inclined position corresponding to the start position for a free bar dip exercise. The dotted line 276 represents the side centerline of the user. It can be seen that this starting position is equivalent to that illustrated in FIG. 5 for the first embodiment, and all of the other previous embodiments. The user's hands are positioned slightly below the shoulder and adjacent the side centerline in the starting position. As the exercise arm 260 is pushed downward by the user, the linear bearings 264 slide downward and rearward along tracks or guide bars 258, pulling cable 274, which in turn pulls on pulley 272 at the upper end of the user support frame, pulling the user support frame 20 rearward to rotate about its pivot connection 270 into the end position of FIG. 38.

Figure 38:
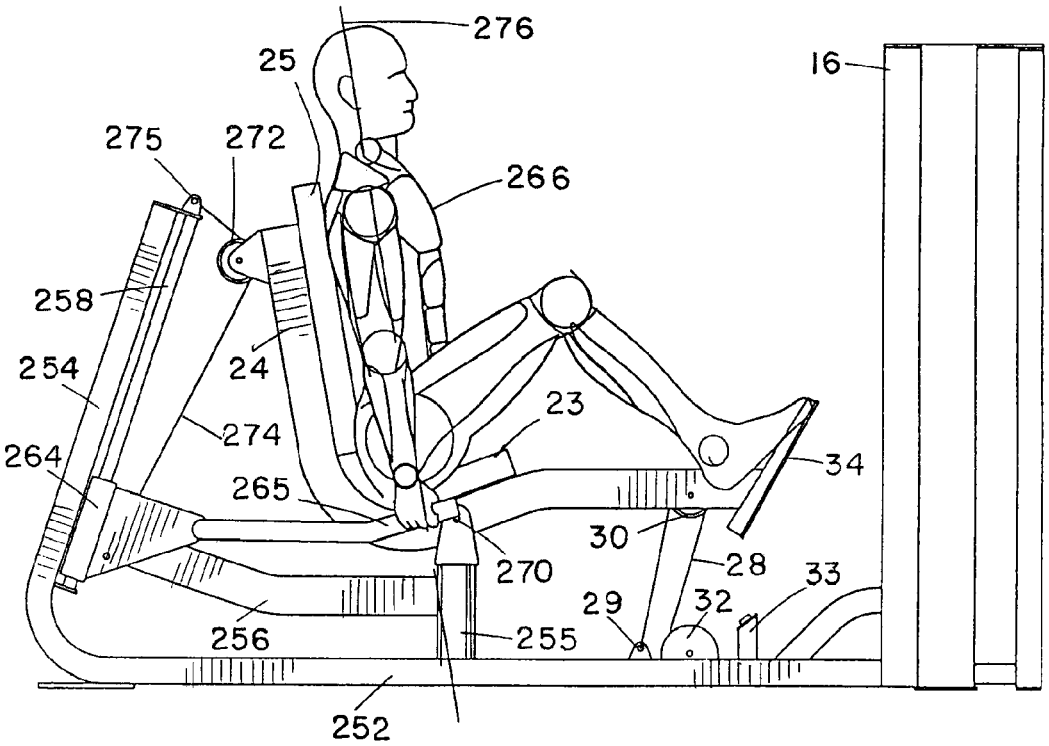
FIG. 38 is a side elevation view of the machine and exerciser of FIG. 37, illustrating the exercise end position.

In the end position of FIG. 38, the user's arms extend down with their arms and hands generally in line with the side centerline 276 of the user's body. This is equivalent to the end position in each of the previous embodiments, as well as to the upper body and arm position at the end of a suspended, free bar dip exercise. This machine therefore provides the same self-aligning movement and proper positioning of the user support and user with a linear movement exercise arm as it does with a rotational movement-exercise arm.

Figure 35:
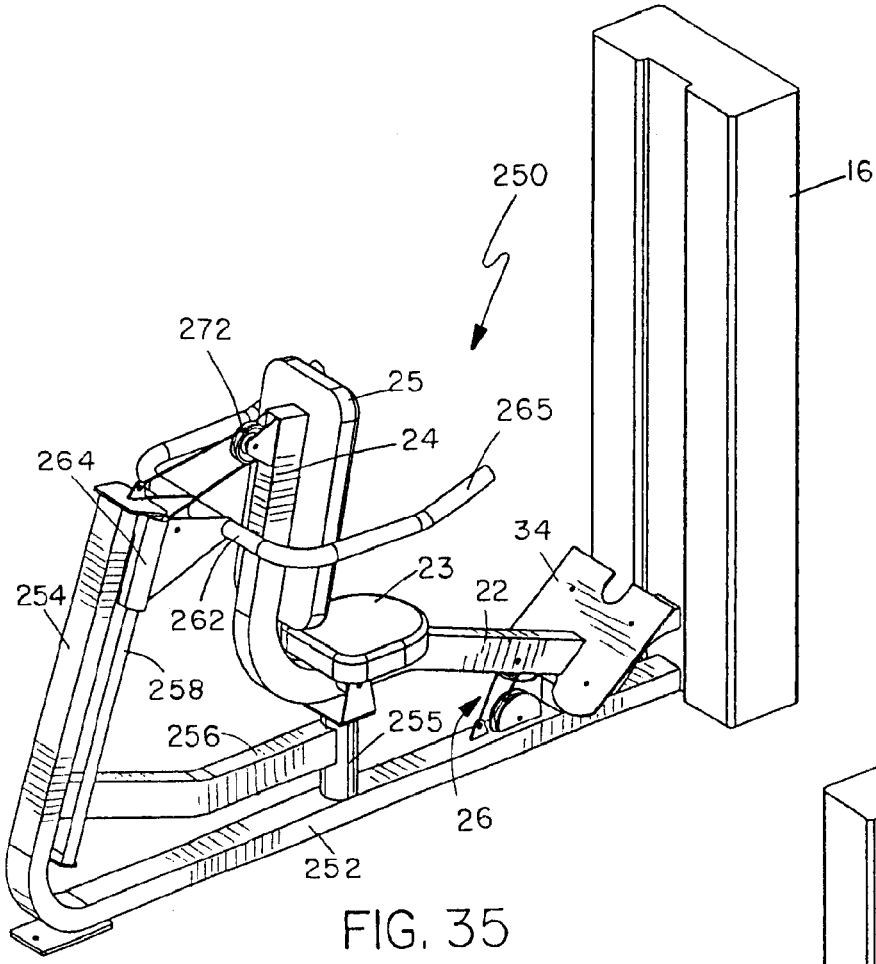
FIG. 35 is a rear perspective view of a modified triceps dip exercise machine, illustrating the exercise start position.
Figure 36:
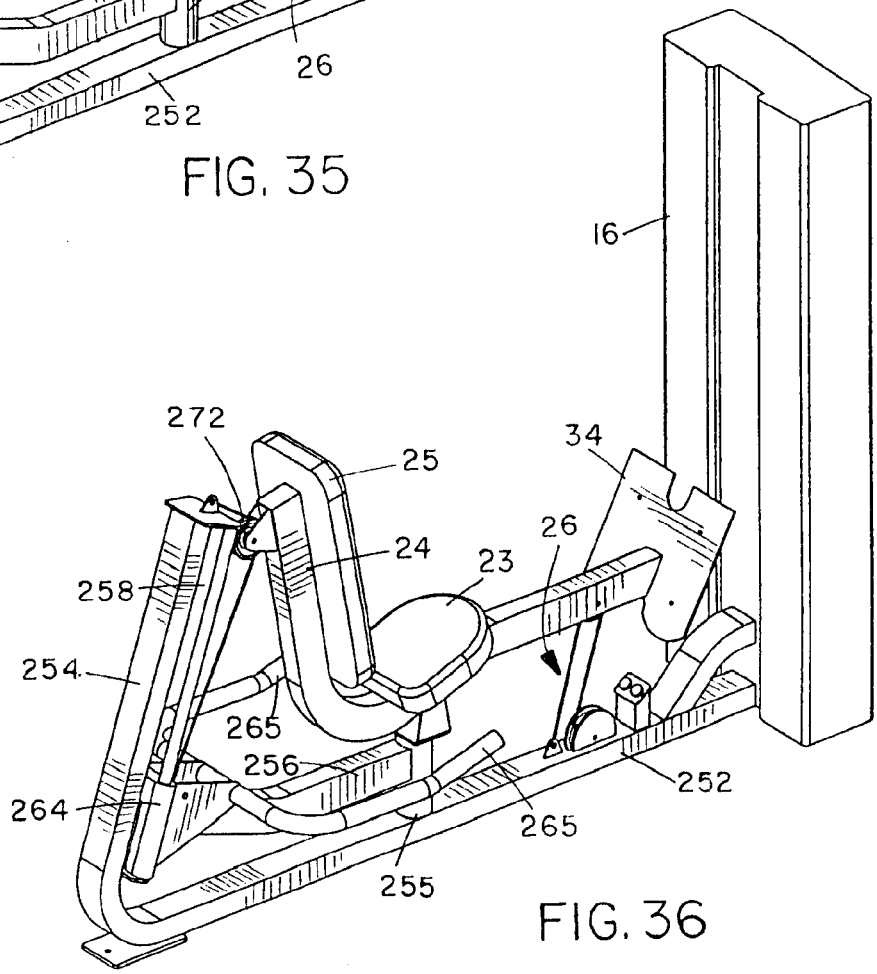
FIG. 36 is a rear perspective of the machine of FIG. 35, illustrating the exercise end position.

In this embodiment, the resistance is connected to the user support frame and a counter-balance, attached to the exercise arm via a cable and pulley system (not shown in the drawings but common in the industry) keeps the arm in the elevated or starting position of FIGS. 35 and 37 when the machine is not in use. Although in this embodiment the resistance is supplied by a weight stack which is linked to the user support via a cable and pulley system, it may alternatively be in the form of hand-loaded weight plates mounted on receiving pegs, as in the embodiment of FIGS. 7 and 8. Other variations could have different types of exercise resistance, and exercise resistance connected directly or indirectly to the exercise arm 260 instead of the user support. In the latter case, the minimum starting weight of the weight stack could be set high enough to act as a counter-balance and offset the weight of the exercise arm, keeping it in the elevated starting position.

Figure 39:
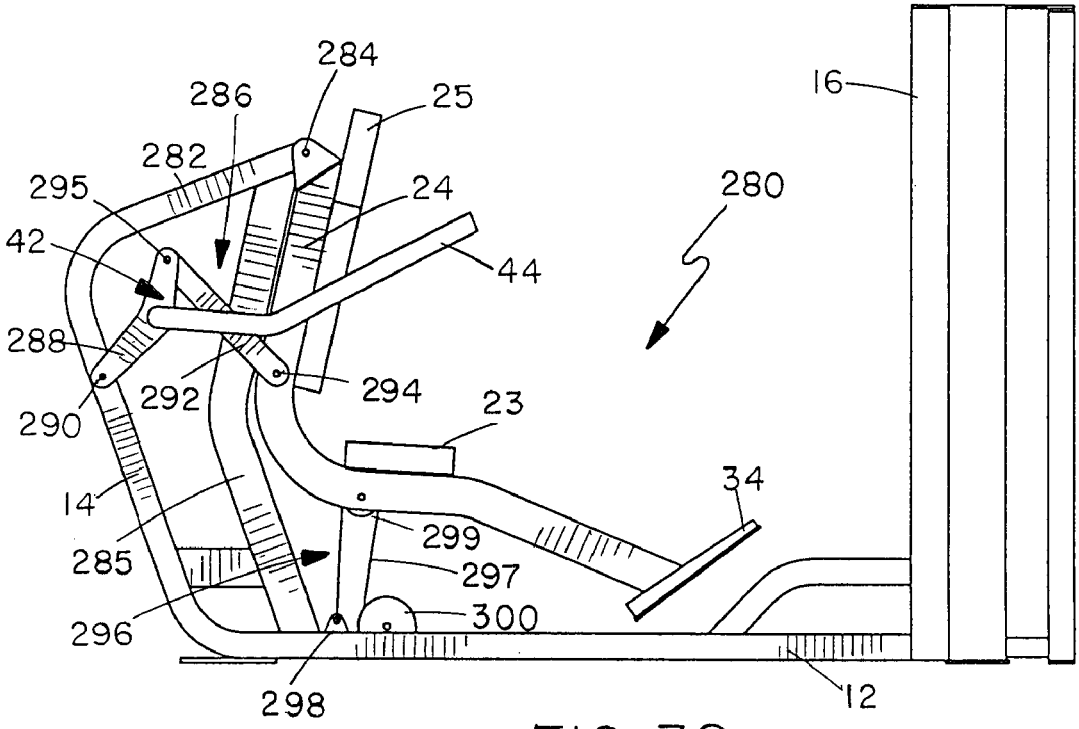
FIG. 39 is a side elevation-view of a modified triceps dip exercise machine, illustrating the exercise start position.
Figure 40:
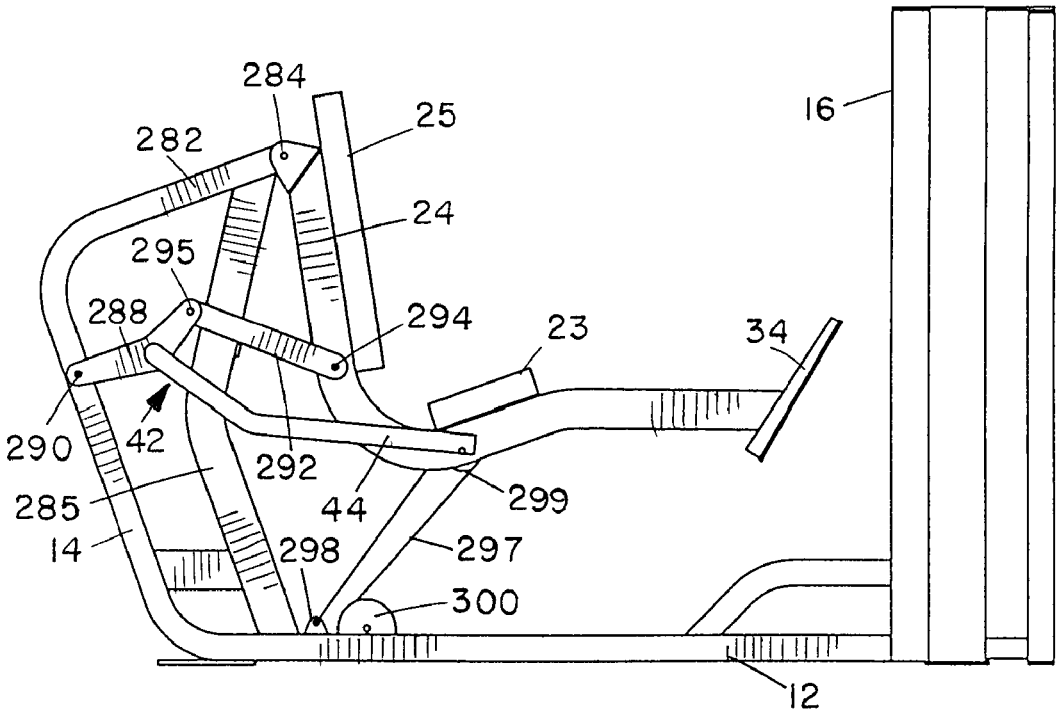
FIG. 40 is a side elevation view of the machine of FIG. 39, illustrating the exercise end position.

FIGS. 39 and 40 illustrate a triceps dip exercise machine 280 according to another embodiment, in which the user support frame travels forward rather than rearward when moving from the start position of FIG. 39 to the end position of FIG. 40. The user support frame 20 is equivalent to that of the first embodiment, and like reference numerals have been used as appropriate. Although the user support frame travels forward during the exercise, the rear upright or back support 24 still rotates from a forward inclined orientation at the start of the exercise into a slightly rearwardly reclined orientation at the end of the exercise.

In this embodiment, the rear upright 14 of the frame is extended to provide a forward bend and forwardly projecting portion 282, and the user support frame is pivotally connected to the forward end of frame portion 282 via pivot 284. A second frame upright 285 extends upwardly from the base at a location spaced forward from rear upright 14, and has a lower, rearwardly inclined portion and an upper, forward inclined portion which acts as a support against which the rear upright 24 of the user support frame rests in the start position of FIG. 39.

The exercise arm 286 has a pair of pivot mounting brackets or plates 288 having rear ends pivotally mounted on the frame rear upright 14 at a location spaced below the upper end of upright 14 via pivot 290. A U-shaped arm identical to that of FIGS. 1 to 6 has a central portion secured to the brackets 288 at a location spaced between their ends, and opposite arm portions 42 which project forward from the central portion on opposite sides of the user support frame, with upwardly bent handles 44 at the forward ends of arm portions 42. A link 292 pivotally connects the exercise arm to the user support frame via a first pivot 294 connecting one end of the link 292 to the rear upright 24 of the user support frame at a location adjacent the lower end of back pad 25, and a second pivotal connection 295 between the opposite end of the link 292 and the forward ends of the exercise arm pivot brackets 288.

The exercise resistance in this case again comprises a selectorized weight stack in housing 16, and is linked to the user support frame via a cable and pulley assembly 296 extending between the underside of user support base 22 and the weight stack. The cable and pulley assembly comprises a cable 297 extending from an anchor 298 on the frame base 12, around a pulley 299 on the user support base 22 beneath the seat pad 23, then around a pulley 300 on the frame base 12 before extending through the base and into the housing 16 for linking to the weight stack. The resistance illustrated in FIGS. 39 and 40 may be replaced by plates loaded on receiving pegs mounted on the user support, as in FIGS. 7 and 8, or the resistance could be attached to the exercise arm as shown in FIGS. 29 and 30 or FIGS. 31 and 32.

With this arrangement, when a user seated on the user support frame in the start position of FIG. 39 grips the handles 44 and pushes down, the exercise arm is rotated downward and rearward about pivot 290. This in turn pushes connecting link 292 forward, forcing the user support frame 20 to move forward so that it pivots about its pivot connection 284 to the main frame, raising the seat pad 23 upward and tilting the back pad 25 rearward, effectively duplicating the exercise arm and user support positioning of the machines in the previous figures.

Figure 41:
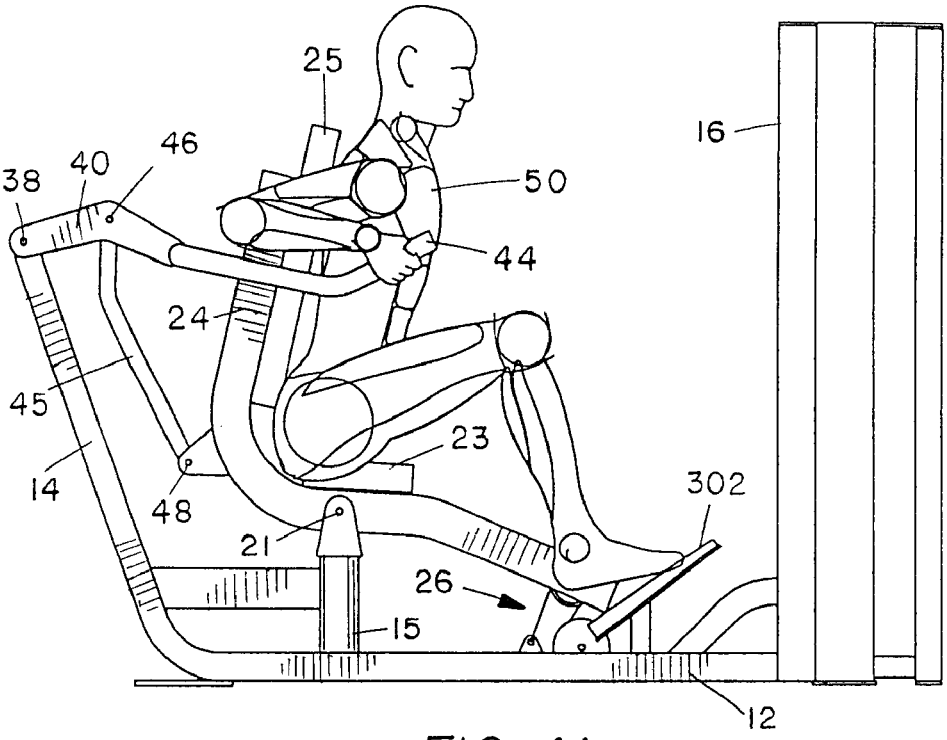
FIG. 41 is a side elevation view of a modified triceps dip exercise machine, illustrating the exercise start position.
Figure 42:
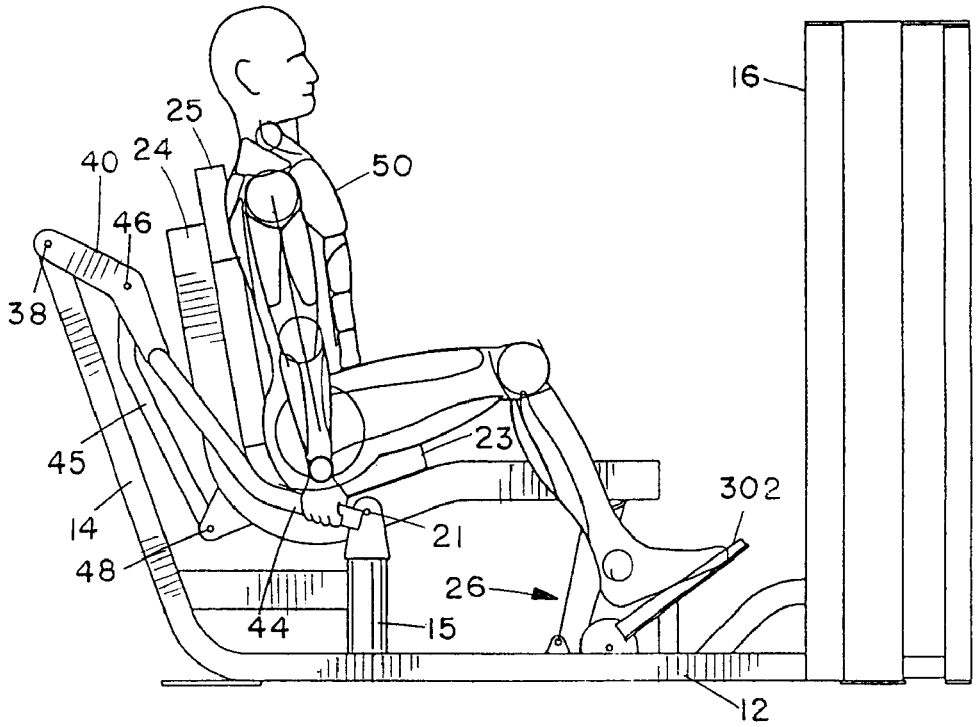
FIG. 42 is a side elevation view of the machine of FIG. 41, illustrating the exercise end position.

FIGS. 41 and 42 illustrate a modification of the embodiment of FIGS. 1 to 6, in which a stationary foot rest 302 is mounted on the base 12 of the main frame, rather than the movable foot rest 34 on the user support as in FIGS. 1 to 6 and other embodiments. All other parts of the machine are identical to that of FIGS. 1 to 6, and like reference numerals have been used as appropriate. It can be seen that the stationary foot rest does not detract from the self-aligning benefits of the exercise arm, pivoted user support, and connecting linkage for ensuring that the user support and user pivot rearwards as the user pushes the handles downward from the start position of FIG. 41 to the end position of FIG. 42. The movement of the user's upper body and arms with the stationary foot rest is substantially identical to the movement when their feet are supported on the moving foot rest, as can be seen by comparison of FIGS. 5 and 6 with FIGS. 41 and 42. Thus, stationary foot rests may be used to replace the moving foot rests in any of the above embodiments or the embodiments described below.

Figure 43:
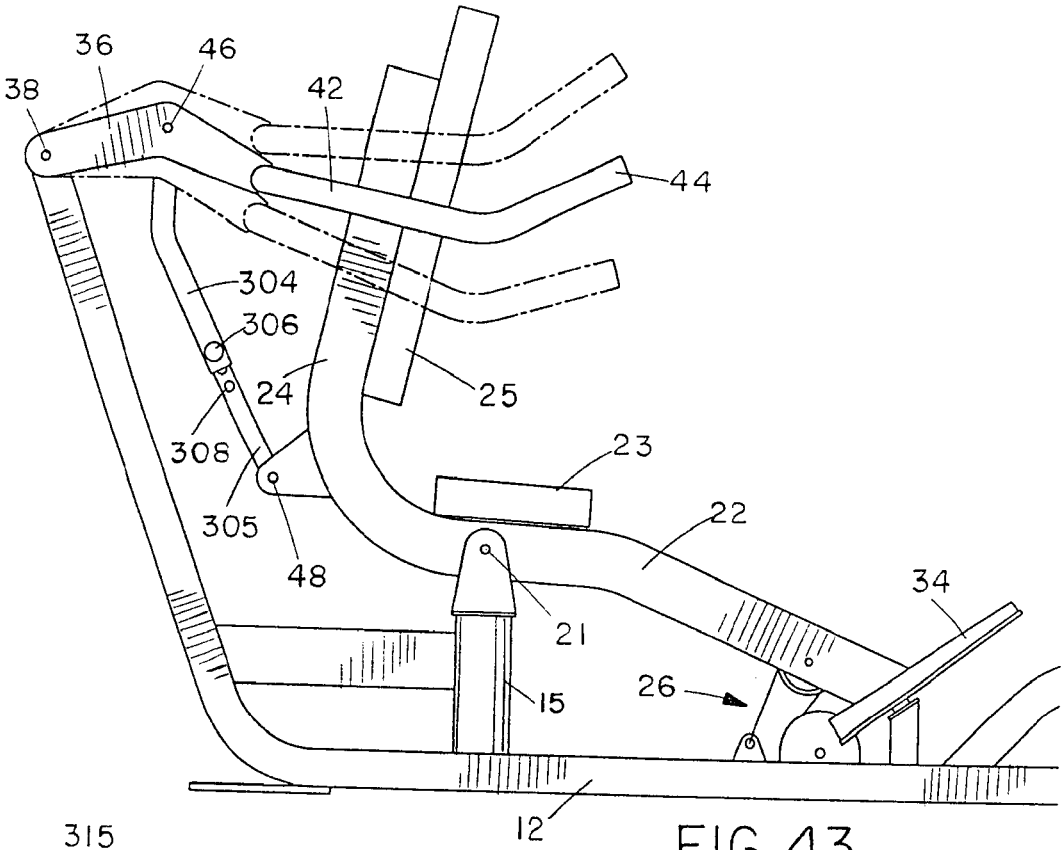
FIG. 43 is a partial side elevation view of a modified version of the machine of FIGS. 1 to 6, in which the connecting link is adjustable in length.

FIG. 43 illustrates another modification of the embodiment of FIGS. 1 to 6 in which the single piece, rigid connecting link of FIGS. 1 to 6 is replaced with an adjustable, two-piece connecting link having a first, tube portion 304 pivoted to the pivot brackets 36 of the exercise arm 35 for rotation about pivot 46, and a second portion 305 telescopically engaged in the end of tube portion 304. The second portion is pivoted to the lower end of the rear upright 24 of the user support via pivot 48, in exactly the same way as link 45 of the first embodiment. A releasable lock or snap pin 306 extends through an opening adjacent the end of tube portion 304 and into a selected opening 308 in the second portion 305 of the connecting link. The length of the connecting link can therefore be adjusted by releasing the lock pin 306 and moving the telescoping link portion 305 into or out of the end of tube portion 304 until the desired length is reached, and then re-engaging the lock pin 306 in the aligned opening 308. Adjustment of the length of the connecting link allows the starting height of the exercise arm to be adjusted, as illustrated in dotted outline in FIG. 43, to adjust to the seated height of the user. All other parts of the machine in FIG. 43 are identical to parts in the first embodiment, and like reference numerals have been used as appropriate.

Figure 44A:
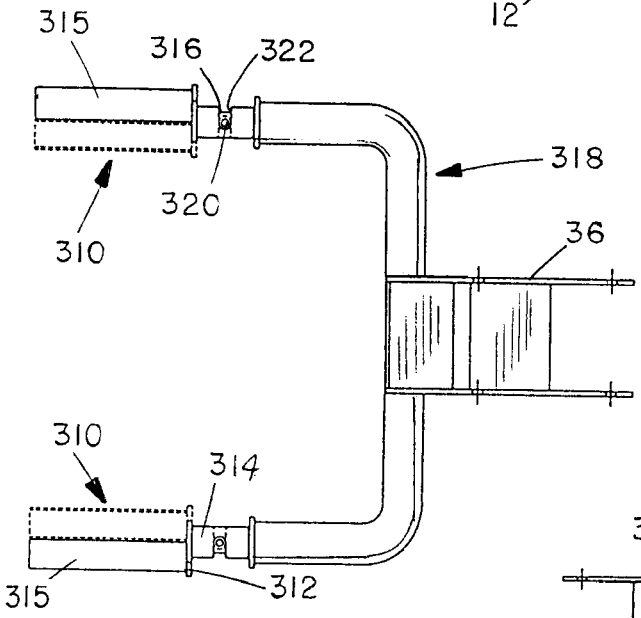
FIG. 44A is a top plan view of a modified exercise arm with adjustable handle spacing.

FIG. 44A illustrates a modification of the U-shaped exercise arm in any of the previous embodiments in which the fixed, angled handles or ends 44 are replaced with adjustable handles 310 which can be adjusted to vary their spacing. The adjustable handles are mounted at the respective ends of a U-shaped member 318 similar to the U-shaped arms of the previous embodiments. The handle adjustment provides proper grip positioning for a variety of users. Each handle 310 comprises a plate 312 having a sleeve 314 extending from its inner face in a direction co-axial with the center of the plate 312, and a hand grip 315 mounted on the opposite, outer face of the plate 312 at an offset position which is not aligned with the sleeve 314. The hand grip 315 may alternatively be co-axial with the center of the plate 312 and the sleeve offset from the center. All that is necessary is that the sleeve and handle are offset and do not share the same central axis. A post or shaft 316 extending from the end of the respective arm of the U-shaped member 318 engages in the end of the sleeve 314, and has a radially projecting pin 320 which engages in a circumferentially extending guide slot 322 in the sleeve. Rotation of sleeves 314 about their central axes of rotation causes rotational displacement of the hand grips 315, varying the distance between them from a maximum as illustrated in solid outline, to a minimum as illustrated in dotted outline. The central portion of the U-shaped member 318 is secured to the exercise arm pivot brackets, such as pivot brackets 36 of the first embodiment above, or any of the exercise arm pivot mounts of the previous embodiments. The user engaging hand grips 315 can have fixed adjusted positions, or may be free swinging so as to align to the width of the user. The grips 315 may be mounted parallel and in line on a U-shaped arm, as illustrated, or may be mounted askew and non-parallel on a V-shaped arm. They may also be mounted at the ends of two separate and independent exercise arms, replacing the hand grips-79 of the independent exercise arms in FIG. 11.

Figure 44B:
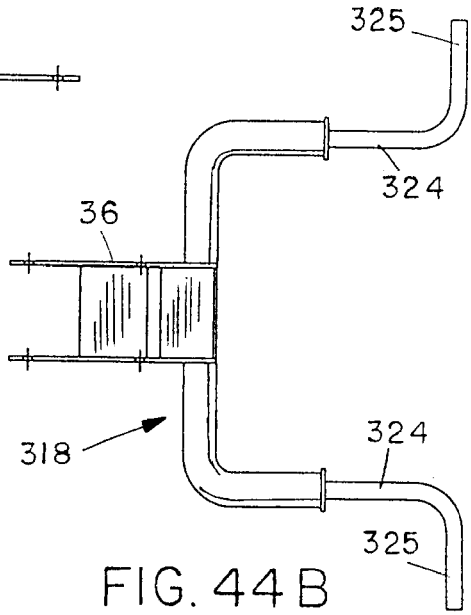
FIG. 44B is a top plan view of another modified handle arrangement providing different grip positions.

FIG. 44B illustrates another optional modification to the exercise arms of the previous embodiments in which multiple grips or hand positions are provided. In this alternative, L-shaped hand grips are secured at the ends of the U-shaped arm 318 in place of the adjustable handles 310 of FIG. 44A. The user may grip the first portion 324 or the outwardly projecting end portion 325 of the hand grip. This multiple hand positioning may be provided in any of the previous embodiments having U-shaped exercise arms, or with the independent exercise arms of FIG. 11, and may also be provided in conjunction with the adjustable width positioning of FIG. 44A. This allows the exerciser to duplicate various hand positions provided in free bar triceps dip exercises.

Each of the embodiments of FIGS. 1 to 43 has a pivoting or rocking user support frame that continuously and automatically self-aligns to the movement of the exercise arm throughout the entire exercise motion, thereby maintaining a desirable alignment relationship between the exerciser positioned on the user support and the user engaging means or handles on the exercise arm. The rocking movement of the user support frame makes the exercise more fun to perform. Additionally, this design provides the proper starting and finishing alignment between the user and machine for an exercise which simulates a free bar dip exercise. The combined motion of the user support frame and exercise arm replicates the natural, small rearward arcing motion an exerciser would go through when performing a free bar dip exercise, and provides the same start and finish position as the free bar exercise. This combined motion of the user support frame and exercise arm also provides a safer and more natural feeling exercise motion, and the user's back is fully supported throughout the exercise so that it is not involved in the exercise. The machines described above are an improvement over the exaggerated and unnatural arcing movement of prior art triceps dip exercise machines.

In most of the embodiments described above, the user support pivot is positioned below the seat pad of the user support frame, so that a portion of the user and user support frame is positioned on both sides of the gravitational center line of the pivot throughout the exercise motion. By placing the user support pivot directly under the user and by having the user and user support frame travel through the gravitational centerline of the pivot during the exercise, the user's body weight is balanced on both sides of the gravitational centerline throughout the exercise and has little effect on the exercise resistance. This limits the effect of the user's body weight on the initial lift or starting resistance and provides counter-balancing to prevent or reduce resistance drop-off at the end of the exercise.

Each of the above triceps dip machines places the user in a forward lean in the start position with their hands gripping the exercise arm handles slightly below their shoulders, and ends with the user's arms extending downward generally along the side centerline of their body, with their upper body in a slightly rearwardly reclined position. This is essentially the same as the start and finish position of a free bar dip exercise. The start position places the user's shoulders slightly forward of their hands, but has the added benefit of taking strain off the user's shoulders because the user does not have to support their body weight, unlike a free bar exercise. The forward lean at the start of a free bar triceps dip exercise is a natural by product of a suspended exerciser performing a bar dip. With these machines, the user is properly positioned in an exercise ready position during the exercise, and does not have to purposely lean forward with no such support at the start of the exercise or during the exercise motion, as in some prior art machines. The machines described above all have user supports which are low to the ground and easily accessible for mounting and dismounting, and do not require the user to climb onto a vertically moving platform or up and down steps in order to reach a user support.

Because the user support frame aligns to the position of the exercise arm throughout the exercise movement, the handle or user engaging device can be angularly positioned to reduce strain on the wrist in the starting position, and maintains proper positioning and alignment of the hands and wrists throughout the exercise. Adjustable handles or multi-grip handles may be provided. The primary and secondary user supports (user support seat and user support back rest) are in fixed alignment to each other and travel together through the same range of motion, and rotate together about a fixed pivot.

It should be understood that the different elements used in the various embodiments described above may be mixed and interchanged. Any of the above linkages between the user support frame and exercise arm may be used in any of the designs described above. The foot rest could be stationary or move with the user support frame. The user supports (seat pad, back pad and/or foot rest) may be fixed or adjustable. The exercise arms may be one piece (dependent) or two pieces (independent), and may be unidirectional or bidirectional. The connecting links may be adjustable in length, solid links may be replaced with flexible links, and the links may be arranged either to push or pull in order to force movement of the user support frame, without affecting the overall function and exercise paths. Different handles may be used without affecting the operation of the machine. The cable and pulley system linked to a weight stack may be replaced with weight plates mounted on pegs. Other types of resistance known in the art, such as hydraulic, pneumatic, or electromagnetic resistance, or elastic bands, may be used in place of the weight stack or weight plates. Cable linkages could be replaced by belts, ropes, chains, or the like, and pulleys may be replaced by sprockets. Any of the various designs could have the resistance associated with any of the moving parts of the machine, i.e. the user support frame, exercise arm, or connecting link.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A triceps dip exercise machine, comprising:

a main frame having a user support mount, a forward end, and a rear end;

a user support frame movably mounted on the user support mount for supporting a user in an exercise position and movable between a start position and an end position;

an exercise arm movably mounted on one of the frames, the exercise arm having handles for gripping by a user in performing a triceps dip exercise and being movable in a first direction between an exercise start position and an exercise end position, the handles being positioned on opposite sides of the user support frame at a first elevation in the exercise start position and at a second elevation lower than the first elevation and below at least part of the user support frame in the exercise end position;

a connecting linkage connecting movement of the exercise arm to movement of the user support frame, whereby movement of the exercise arm from the start to the end position simultaneously moves the user support frame from the start to the end position; and a load which provides exercise resistance to movement of at least one of the user support frame, exercise arm, and connecting linkage, the exercise resistance being provided only when the exercise arm is moved in the first direction.

2. The machine as claimed in claim 1, wherein the end position of the user support frame is displaced rearwards relative to the start position.

3. The machine as claimed in claim 1, wherein the start position of the user support frame is a forwardly inclined position.

4. The machine as claimed in claim 2, wherein the end position of the user support frame is a rearwardly reclined position.

5. A triceps dip exercise machine, comprising:

a main frame having a user support mount, a forward end, and a rear end;

a user support frame movably mounted on the user support mount for supporting a user in an exercise position and movable between a start position and an end position;

an exercise arm movably mounted on one of the frames, the exercise arm having handles for gripping by a user in performing a triceps dip exercise and the exercise arm being movable between a start position in which the handles are at a first elevation and an end position in which the handles are at a second elevation lower than the first elevation;

a connecting linkage connecting movement of the exercise arm to movement of the user support frame, whereby movement of the exercise arm from the start to the end position simultaneously moves the user support frame from the start to the end position;

a load for resisting movement of at least one of the user support frame, exercise arm, and connecting linkage; and the user support frame has a primary user support portion and a secondary user support portion which are at different elevations and which are fixed in position relative to one another throughout the exercise movement.

6. The machine as claimed in claim 5, wherein at least a portion of the user support frame in the end position is positioned upward from the start position.

7. The machine as claimed in claim 5, wherein the primary user support is a seat pad.

8. The machine as claimed in claim 6, wherein the secondary user support is an upper body support.

9. The machine as claimed in claim 8, wherein the secondary user support is a back pad.

10. The machine as claimed in claim 9, wherein the back pad is displaced rearward relative to the start position in the end position.

11. The machine as claimed in claim 5, wherein the secondary user support is a lower leg support.

12. The machine as claimed in claim 1, wherein the exercise arm is moveably mounted on one of the frames for rotation about an exercise arm pivot.

13. The machine as claimed in claim 1, wherein the exercise arm is moveably mounted on one of the frames for movement in a linear path.

14. The machine as claimed in claim 1, wherein the start positions of the exercise arm and user support frame place the handles on opposite sides of the user's body, under the shoulder, and the end positions of the exercise arm and user support frame place the handles slightly below the user's hips, whereby the user starts the exercise with their elbows bent and their hands gripping the handles slightly below their shoulders, and finishes the exercise with their arms extending downward on opposite sides of their body.

15. The machine as claimed in claim 1, wherein a pair of independently movable exercise arms are movably mounted on one of the frames, each exercise arm having a handle for engagement by a respective one of the user's hands.

16. The machine as claimed in claim 1, wherein the connecting link is a rigid link.

17. The machine as claimed in claim 1, wherein the connecting link is adjustable in length.

18. The machine as claimed in claim 1, wherein the connecting link is a flexible link.

19. A triceps dip exercise machine for performing exercises equivalent to a free bar dip exercise, comprising:

a main frame having a forward end and a rear end;

a user support mount on the main frame;

a user support frame movably mounted on the user support mount, the user support frame comprising a first moving part of the machine, and having a first support portion and a second support portion which support different body portions of a user's body;

at least one user engageable device movably mounted on one of the frames which is engaged by the user in performing exercises, and comprising a second moving part of the machine;

a connecting link movably engaged with at least two of the main frame, user support frame and user engageable device for linking movement of the user engageable device to movement of the user support frame, the connecting link comprising a third moving part of the machine; and a load for resisting movement of at least one of the first, second, and third moving parts of the machine;

whereby movement of the user engageable device from a start position to an end position simultaneously moves the user support frame between a start position and an end position, the second support portion of the user support frame being fixed in position relative to the first support portion throughout the exercise movement.

20. The machine as claimed in claim 19, wherein the user engageable device has at least one handle which is gripped by a user in performing exercise.

21. The machine as claimed in claim 20, wherein the user engageable device comprises at least one exercise arm, and the exercise arm and user support frame are positioned relative to one another in the start position such that the handle is located below the shoulders of a user positioned on the user support frame, and are positioned relative to one another in the end position such that the handle is located below the hips of the user positioned on the user support frame, whereby the user's arms extend downward in the exercise end position.

22. The machine as claimed in claim 20, wherein the user engageable device comprises an exercise arm having opposite arm portions extending on opposite sides of the user support frame and a handle at the end of each arm portion.

23. The machine as claimed in claim 19, wherein one of the support portions on the user support frame is a lower leg supporting portion.

24. The machine as claimed in claim 19, wherein the user support mount is located behind at least one support portion of the user support frame.

25. The machine as claimed in claim 23, wherein the other support portion on the user support frame is a seat pad.

26. The machine as claimed in claim 19, wherein the user support mount is located beneath at least the first support portion of the user support frame.

27. The machine as claimed in claim 19, wherein the first support portion is located at a different elevation from the second support portion through at least part of an exercise movement.

* * * * *